United States Patent [19]

Imamura et al.

[11] 4,326,441

[45] Apr. 27, 1982

[54] AUTOMATIC PERFORMANCE DEVICE

[75] Inventors: Akio Imamura; Akiyoshi Oya, both of Hamamatsu, Japan

[73] Assignee: Nippon Gakki Seizo Kabushiki Kaisha, Hamamatsu, Japan

[21] Appl. No.: 140,484

[22] Filed: Apr. 15, 1980

[30] Foreign Application Priority Data

Apr. 19, 1979 [JP] Japan ..... 54-48277

[51] Int. Cl.[3] ..... G10H 1/42; G10H 7/00

[52] U.S. Cl. ..... 84/1.03; 84/DIG. 12

[58] Field of Search ..... 84/1.01, 1.03, 1.17, 84/1.24, DIG. 12, DIG. 22

[56] References Cited

U.S. PATENT DOCUMENTS 3,958,483 5/1976 Borrevik et al. ..... 84/1.03

3,990,339 11/1976 Robinson et al. ..... 84/1.17

4,072,078 2/1978 Shallenberger et al. ..... 84/1.03

4,208,938 6/1980 Kondo ..... 84/1.03

*Primary Examiner*—S. J. Witkowski

*Attorney, Agent, or Firm*—Spensley, Horn, Jubas & Lubitz

[57] ABSTRACT

An automatic performance device comprises a pattern memory for storing a plurality of performance patterns and a sequence memory for storing a pattern progression. The pattern progression is programable and is written in the sequence memory. The performance patterns are selected one by one from the pattern memory according to the pattern progression. Each selected performance pattern is read out according to a tempo pulse. An automatic performance is carried out on the basis of the read-out performance pattern.

28 Claims, 15 Drawing Figures

AUTOMATIC PERFORMANCE DEVICE

BACKGROUND OF THE INVENTION

This invention relates to an automatic performance device which automatically produces tones of rhythm musical instruments such as drums and cymbals, or tones of musical scale as accompaniment by bass tones, chord tones or arpeggio tones played on the keyboard.

An automatic performance device is well known in the art, in which a plurality of performance patterns (a rhythm section pattern, a bass pattern, a chord pattern and an arpeggio pattern) are stored in a pattern memory corresponding to various rhythms, a desired performance pattern (consisting of specific pattern pulses) corresponding to a specified rhythm is read out of the pattern memory by utilizing as an address generator a tempo counter driven by a tempo pulse in accordance with a rhythm specifying signal from a rhythm selection switch, and various rhythm tone generators, an automatic bass chord performance unit or an automatic arpeggio performance unit are controlled according to the performance pattern thus read, thereby to automatically perform rhythm section tones, bass tones, chord tones or arpeggio tones.

In the conventional automatic performance device, a performance pattern read out of the pattern memory is determined by the rhythm specifying signal provided by the rhythm selection, the pattern memory stores patterns for only two measures at maximum because of its capacity, and it is difficult to change the rhythm specifying signal by operating the rhythm selection switch during the performance. Therefore, if a rhythm is determined by the rhythm specifying signal, then the performance pattern corresponding to the rhythm thus determined is merely repeated every two measures. Thus, the automatic performance is considerably monotonous.

SUMMARY OF THE INVENTION

In view of the foregoing, an object of this invention is to provide an automatic performance device in which a performance pattern progression can be programmed as desired, thereby to carry out an automatic performance rich in variation.

In an automatic performance device according to the invention, a pattern progression is programmed by successively writing signals representing specified patterns, which are selected by a pattern selection switch, into a sequence memory, and desired performance patterns are successively read out of a pattern memory which stores a plurality of different performance patterns, according to the pattern progression thus programmed, thereby to automatically produce rhythm section tones, bass tones, chord tones or arpeggio tones varying according to the programmed pattern progression.

The nature, principle and utility of the invention will become more apparent from the following detailed description when read in conjunction with the accompanying drawings, in which like parts are designated by like reference numerals or characters.

DETAILED DESCRIPTION OF THE INVENTION

Figure 1:
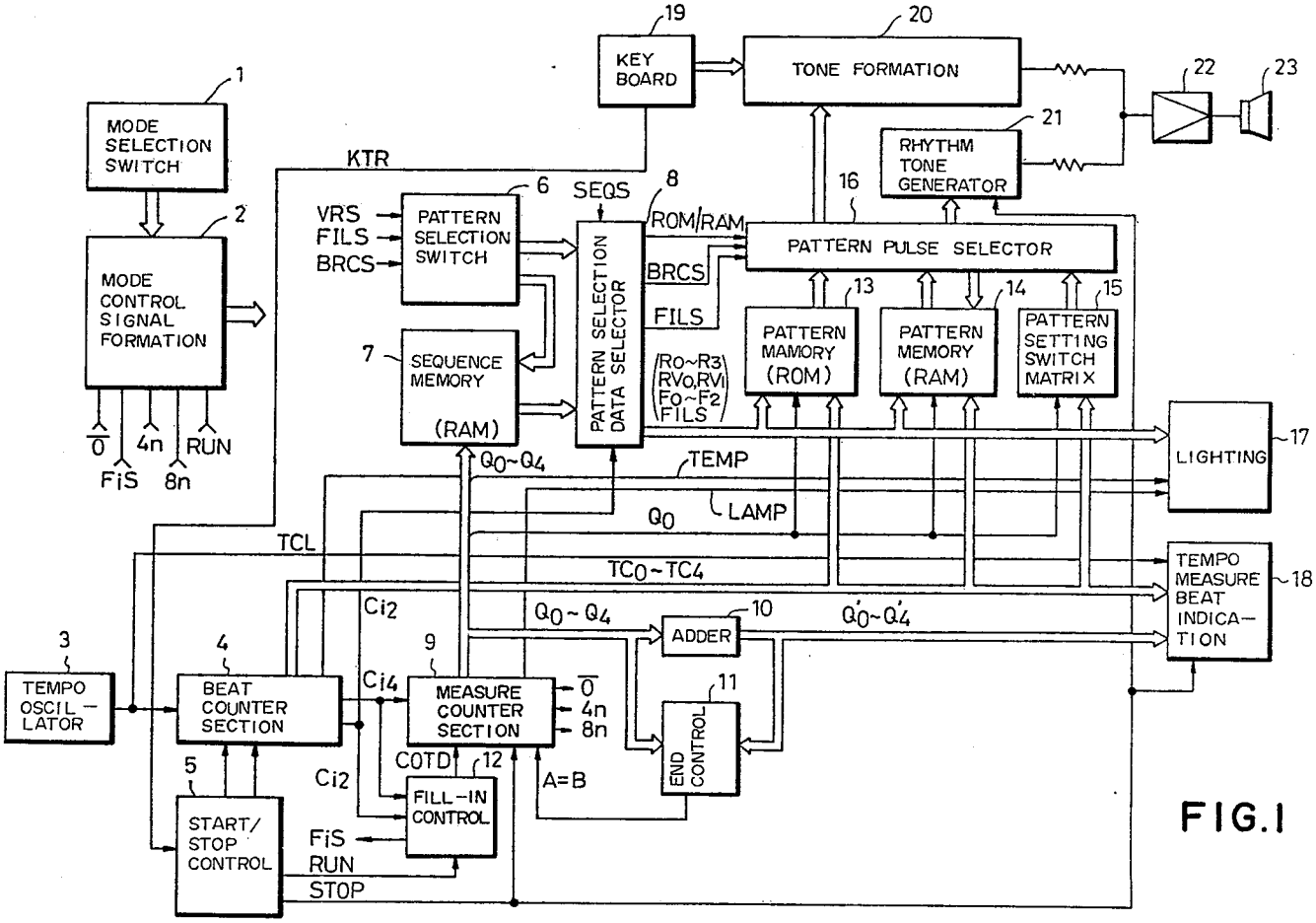
FIG. 1 is a block diagram showing one example of an automatic performance device according to this invention.
Figure 2:
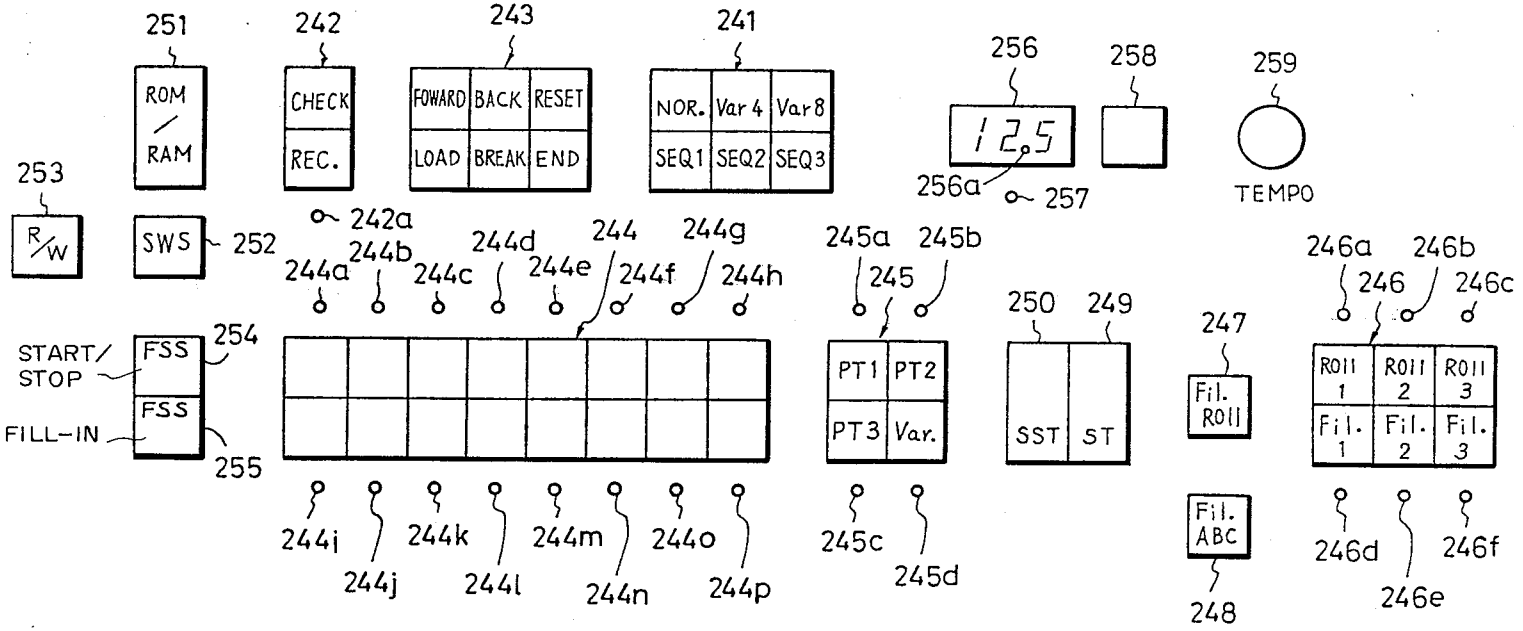
FIG. 2 is an explanatory diagram showing the arrangement of various control buttons, etc. in the device shown in FIG. 1.

One preferred example of an automatic performance device according to this invention as shown in FIG. 1 is controlled by various buttons (or operating controls) on a panel 24 shown in FIG. 2.

First, the functions of the various buttons and the functions of display units on the panel 24 will be described.

Description of the Functions of the Buttons and the Functions of the Display Units A group of buttons 241 is of a mechanical lock-/release type that when a button in the group is depressed, then the button is locked at the depressed state, and the remaining buttons, if any, are automatically released to their normal (undepressed) state. The functions of the buttons in the group 241 are as follows:

Button "NOR."—This is to specify a normal performance mode. The depression of the button provides a performance pattern according to the rhythm selection by a group of buttons 244 and the variation selection by a group of buttons 245 (described later).

Buttons "Var4" and "Var8"—These are to specify variation performance modes. The depression of the button Var4 provides a performance pattern in which a normal pattern is shifted to (substituted by) a variation pattern in every fourth measure. The depression of the button Var8 provides a performance pattern in which a normal pattern is shifted to (substituted by) a variation pattern in every eighth measure.

Buttons "SEQ1", "SEQ2" and "SEQ3"—These buttons are used for addressing in programming a pattern progression in a sequence memory 7 (FIG. 1) described later. The sequence memory 7, having three memory units SEQ1, SEQ2 and SEQ3, can store three different programs (sequences).

A button group 242 consists of a button "CHECK" and a button "REC". Each button is locked at the depressed state when depressed once, and it is released when depressed again. In other words, each button is of a push-on/push-off type. The functions of these buttons are as follows:

Button "REC"—This is to specify a program mode to program a pattern progression in the sequence memory 7 (FIG. 1).

Button "CHECK"—This is to specify a check mode that the pattern progression programmed in the sequence memory 7 (FIG. 1) is checked every measure.

A light emitting diode 242*a* is provided near the button "REC". When the pattern progression is being loaded into the sequence memory 7 (FIG. 1), the light emitting diode 242*a* is kept lit to indicate that the programming is being carried out. When the addresses in the sequence memory 7 overflow, the diode 242 flickers to inform that no further loading is possible.

The buttons of a button group 243 are of a self release type that a button is kept turned on only while it is kept depressed, but it is automatically restored (turned off) when the depression is released. The functions of these buttons are as follows:

Button "FORWARD"—This is used in a program mode or a check mode, and is adapted to move a measure number (a program number) forward by one step.

Button "BACK"—This is used in a program mode or a check mode, and is adapted to move a measure number (a program number) backward by one step.

Button "RESET"—This is to return a measure number (a program number) to the first measure.

Button "LOAD"—The button is depressed every step in a program mode, to specify the loading of the pattern progression into the sequence memory 7 (FIG. 1).

Button "BREAK"—This is used to specify "break (inhibition of a pattern generation)" in a program mode.

Button "END"—This is used to instruct for the ending of programming in a program mode.

A button group 244 has rhythm selection buttons adapted to select kinds of rhythm. The rhythm selection buttons are provided for sixteen (16) rhythms such as march, waltz and jazz waltz, respectively. The buttons are of a mechanical lock/release type which has been described with respect to the button group 241. Sixteen light emitting diodes (LED) 244*a* through 244*p* are provided near the sixteen buttons, to indicate the rhythms selected, respectively.

A button group 245 consisting of pattern specifying buttons is adapted to specify one of four different patterns PT1, PT2, PT3 and Var which corresponds to a rhythm specified by the rhythm selection button group 244. In the automatic performance device according to the invention, four patterns, i.e. three normal patterns PT1, PT2 and PT3 and one variation pattern Var, are set for every rhythm. Among the four patterns, one is selected by the pattern specifying button group 245. Four light emitting diodes 245*a* through 245*d* are provided near the four buttons, to indicate the patterns specified, respectively. The pattern specifying button group 245 is of a mechanical lock/release type that when one of the buttons is depressed, the remaining buttons are automatically restored.

A button group 246 consists of fill-in pattern specifying buttons and roll pattern specifying buttons. A fill-in pattern is a special pattern in which drum solo is essential. A roll pattern is also a special pattern of a snare drum being continuously subjected to percussion. The button group 246 is so designed as to specify three different fill-in patterns Fil-1, Fil-2 and Fil-3 and three different roll patterns Roll-1, Roll-2 and Roll-3. Light emitting diodes (LED) 246*a* through 246*f* provided near the six buttons of the group 246 are adapted to indicate the selected fill-in or roll patterns, respectively. The button group 246 is also of the mechanical locking type.

A button "Fil.Roll" 247 is a fill-in select button which is depressed when it is required to insert a fill-in pattern or a roll pattern during or before the progress of a rhythm or during programming. The fill-in select button is of the self restoring type similarly as in the buttons of the group 243.

A button "Fil.ABC" 248 is an ABC fill-in select button which is adapted to determine whether or not a special pattern provided in response to the selection of a fill-in pattern or a roll pattern should be applied to automatic bass chord performance. The ABC fill-in selection button is of a push-on/push-off type similarly as in the button group 242.

A start switch "ST" 249 and a synchronous start switch "SST" 250 are to control the rhythm progression. More specifically, when the start switch 249 is turned on, a rhythm section performance is started, and when the switch 249 is turned off the rhythm performance is stopped. The synchronous start switch 250 is adapted to control the start and stop of a rhythm in synchronization with key depression in a keyboard 19 (FIG. 1). Each of the switches 249 and 250 is a see-saw type on-off switch.

A ROM/RAM change-over switch "ROM/RAM" 251 is to select a pattern memory (ROM) 13 for storing plural performance patterns or a pattern memory (RAM) 14 (FIG. 1) into which patterns can be loaded. When the pattern memory 13 is selected, a performance pattern is read out of the pattern memory 13. When the pattern memory 14 is selected, a performance pattern is read out of the pattern memory 14. The ROM/RAM changeover switch 251 is also of a see-saw type on-off switch.

A button "SWS" 252 and a button "R/W" 253 are used to load a performance pattern set by a pattern setting switch matrix circuit 15 (FIG. 1) into the pattern memory 14. More specifically, the depression of the button 252 causes a pattern pulse selection 16 (FIG. 1) to select an output of the pattern setting switch matrix circuit 15. The depression of the button 253 makes it possible for the pattern memory (RAM) 14 to perform loading. The buttons 252 and 253 are of a push-on/push-off type.

A start stop foot switch select button "FSS Start/-Stop" 254 is to allow a foot switch (not shown) to control the start and stop of a rhythm. A fill-in foot switch select button "FSS Fill-in" 255 is to allow the foot switch to insert a fill-in pattern or a roll pattern. More specifically, upon depression of the button 254, the foot switch serves to control the start and stop of a rhythm; that is, the rhythm is started or stopped by the foot switch. Upon depression of the button 255, the foot switch serves to control the insertion of a fill-in pattern or a roll pattern; that is, the insertion of a fill-in pattern or a roll pattern is controlled by the foot switch. The buttons 254 and 255 are of a push-on/push-off type.

A display unit 256 operates to digitally display measure numbers and beat numbers. The display unit 256 in the example is used for displaying three different data: tempo, measure number and beat number. Before a rhythm is started, the display unit 256 displays a tempo. After the rhythm has been started, the display unit 256 indicates a measure number and a beat number simultaneously. In a program mode or a check mode, the display unit 256 displays a measure number. The display unit 256 has a light emitting diode (LED) 256*a*, which is turned on so as to distinguish a measure number and a beat number from each other when they are displayed simultaneously on the display unit 256.

A light emitting diode (LED) 257 is to indicate a tempo. In other words, the light emitting diode 257 is turned on and off in synchronization with the tempo.

A tempo indication select button 258 is to cause the display unit 256 to numerically indicate a tempo during the progress of a rhythm. More specifically, depression of the tempo indication select button 258 during the progression of a rhythm performance causes the display unit 256 which has displayed a measure number and a beat number to display a tempo in the form of digits. The button 258 is also of a push-on/push-off type.

A tempo adjusting variable resistor 259 is to adjust the tempo. The value of the tempo is varied by operating the tempo adjusting variable resistor 259.

The functions of the various buttons and the display elements are as described above. The automatic performance device according to the invention is operated in the following operation modes (roughly classified) according to the operations of the abovedescribed buttons in the panel section:

(1) Normal performance mode
(2) Variation performance mode
(3) Program mode
(4) Program check mode
(5) Program performance mode
(6) Pattern memory (RAM) loading mode
(7) Fill-in roll performance mode.

These modes will be described in detail with reference to a block diagram in FIG. 1 and detailed circuit diagrams related thereto.

Brief Description of the Entire Circuitry

The entire arrangement of the automatic performance device according to the invention will be described with reference to FIG. 1.

Figure 3:
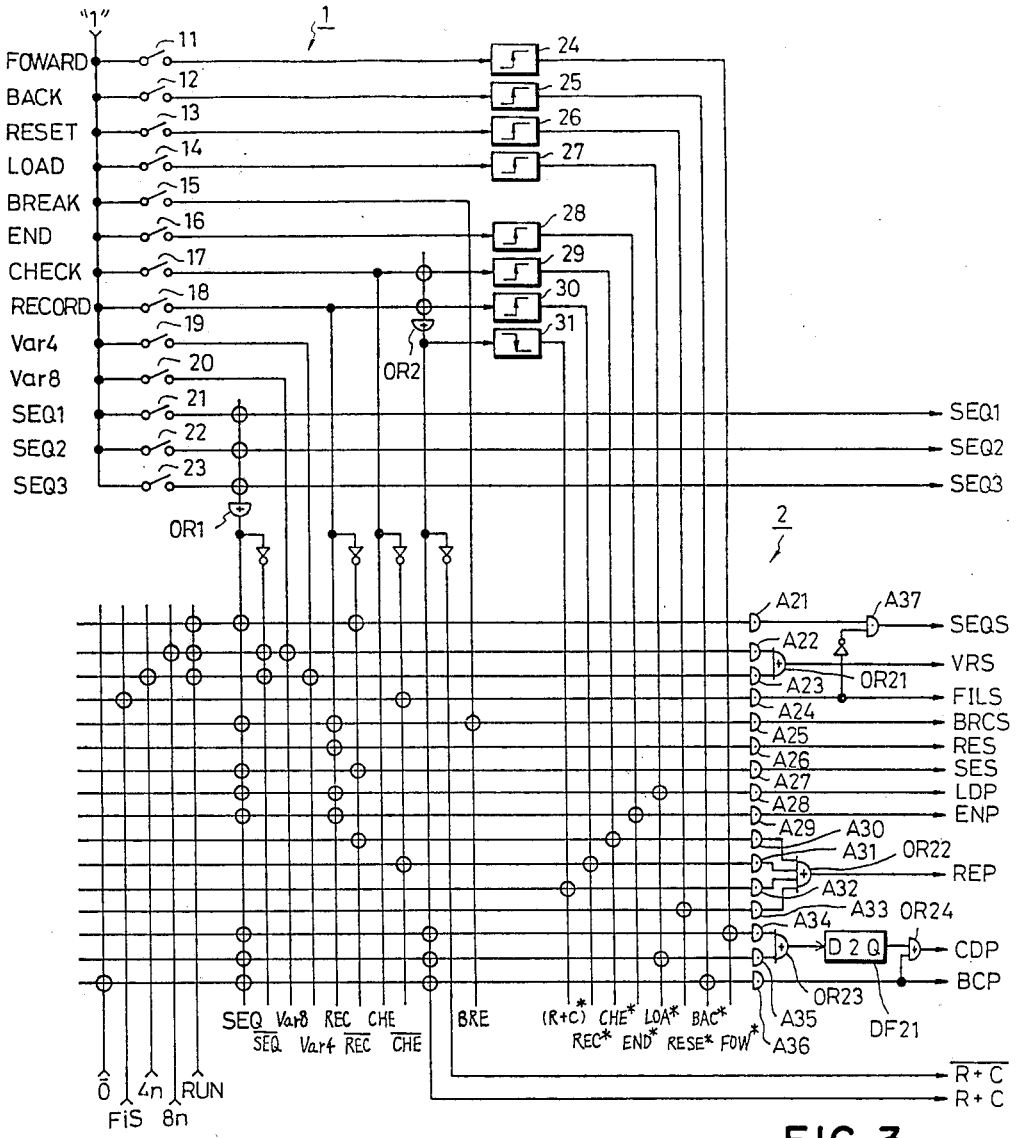
FIG. 3 is a circuit diagram showing the details of a mode selection switch circuit and a mode control signal forming circuit in the device shown in FIG. 1.

A mode selection switch circuit 1 is provided in correspondence to the button groups 241, 242 and 243 in the panel section 24 (FIG. 2), and includes switches which are turned on and off in response to the operations of the button groups 241, 242 and 243. An operation mode is selected for the device of the invention according to the result of operation of the mode selection switch circuit 1, and a mode control signal corresponding to an operation mode selected is formed by a mode control signal forming circuit 2. The mode selection switch circuit 1 and the mode control signal forming circuit 2 are illustrated in FIG. 3 in detail.

A pattern selection switch circuit 6 includes switches corresponding to the rhythm selection button group 244, pattern specifying button group 245 and fill-in or roll pattern specifying button group 246, and the ROM/RAM change-over switch 251 (FIG. 2). The circuit 6 provides pattern selection data which specifies a performance pattern, according to the operations of these switches.

A sequence memory (RAM) 7 is a loadable memory. In the program mode, the memory successively stores pattern selection data provided by the pattern selection switch circuit 6, thereby to program the progression sequence of the patterns.

A pattern selection data selector 8 operates to select the pattern selection data provided by the pattern selection switch circuit 6 or the pattern selection data read out of the sequence memory (RAM) 7. For instance, in the ordinary performance mode, the selector 8 selects the pattern selection data from the pattern selection switch circuit 6; in the program performance mode, it selects the pattern selection data from the sequence memory (RAM) 7.

Figure 4:
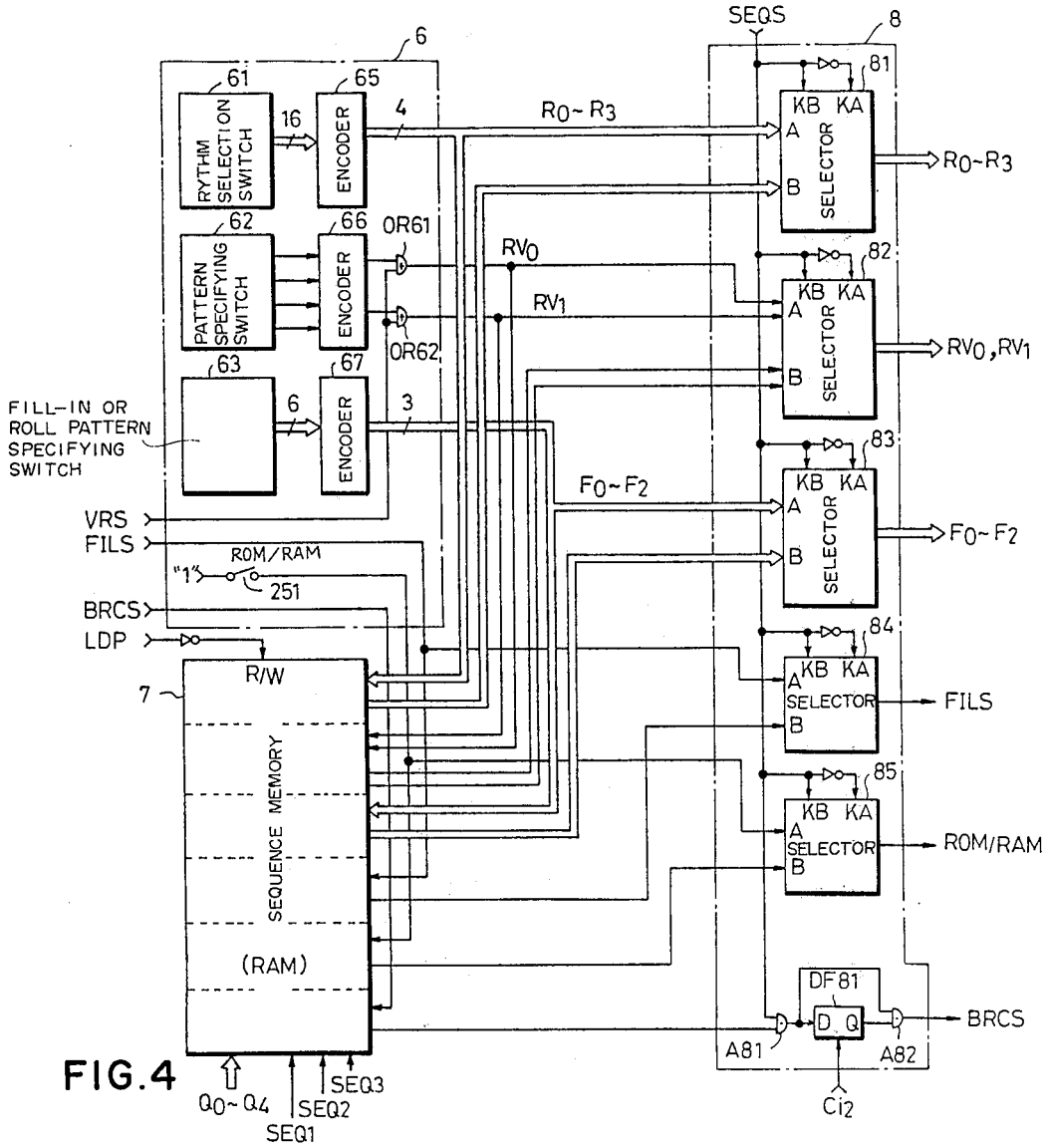
FIG. 4 is a circuit diagram illustrating the details of a pattern selection switch circuit, a sequence memory and a pattern selection data selector in the device in FIG. 1.

The pattern selection switch circuit 6, the sequence memory (RAM) 7 and the pattern selection data selector 8 are shown in FIG. 4 in detail.

A beat counter section 4 operates to count a tempo pulse generated by a tempo oscillator 3, to provide address signals TC0 through TC4 for addressing a pattern memory (ROM) 13, a pattern memory (RAM) 14 and a pattern setting switch matrix circuit 15 (described later). Furthermore, the beat counter section 4 outputs a beat pulse Ci2 at every beat, provides a measure pulse Ci4 at every measure, and produces a tempo signal TEMP representative of a tempo. Before a rhythm performance is started, the tempo signal TEMP becomes a pulse signal which is produced every beat pulse Ci2 under the condition that the synchronous start switch 250 (FIG. 2) is turned on. During the progress of the rhythm performance, the tempo signal TEMP becomes a pulse signal which is produced every measure pulse Ci4.

A start/stop control circuit 5, in response to the operations of the start switch 249 and the synchronous start switch 250 (FIG. 2) and a key-on signal KTR from a keyboard section 19, which is representative of key depression in the keyboard section 19, produces a control signal for controlling the operation of the beat counter 4, and provides a rhythm stop signal STOP representative of the fact that a rhythm is stopped or a rhythm run signal RUN representative of the fact that a rhythm is running.

Figure 5:
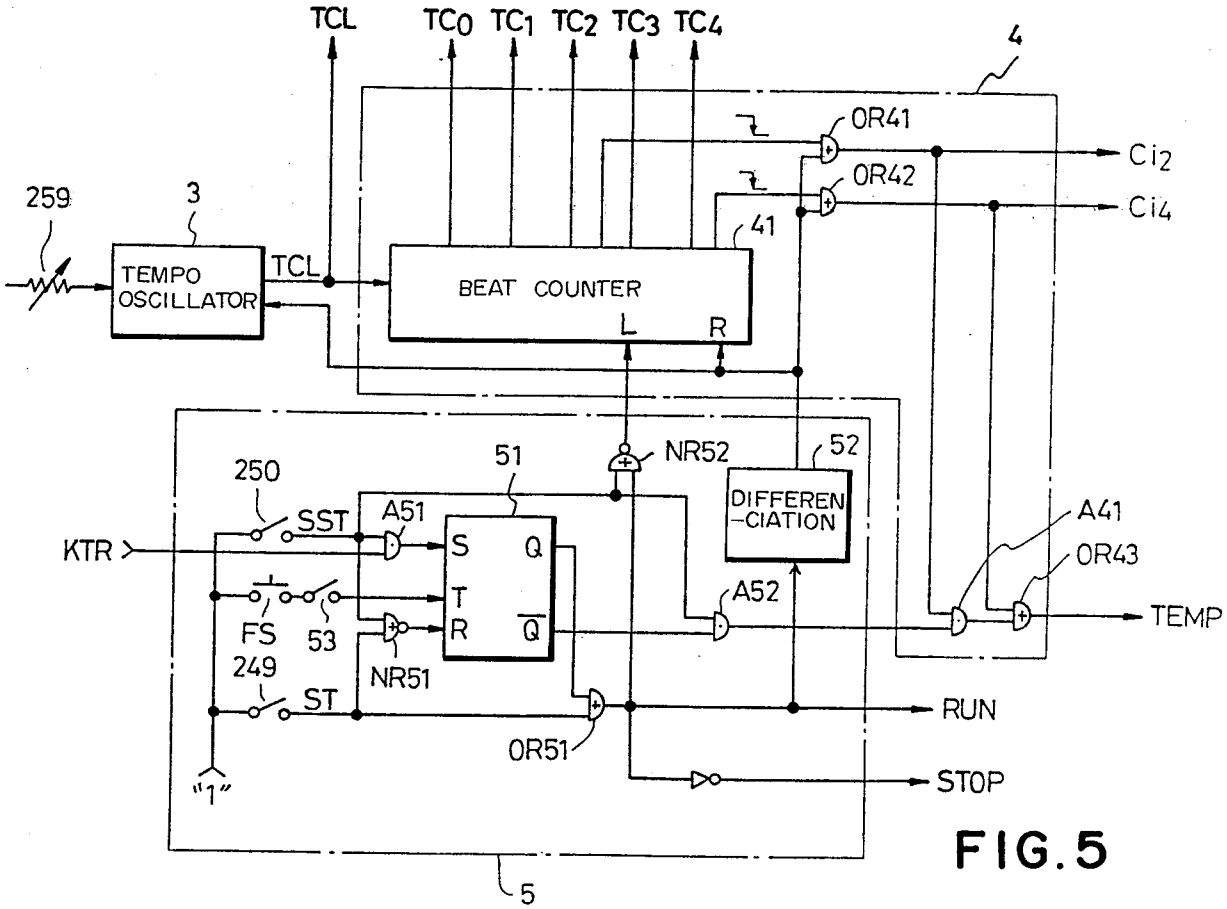
FIG. 5 is a circuit diagram showing the details of a start/stop control circuit and a beat counter section in the device shown in FIG. 1.

The beat counter section 4 and the start/stop control circuit 5 are illustrated in FIG. 5 in detail.

A measure counter section 9 counts a measure pulse Ci4 provided by the beat counter section 4, to output a signal Q0–Q4 representative of measure progression (measure number representing the order of measure). The signal Q0–Q1 is employed as an address signal for addressing the sequence memory (RAM) 7, and is applied to an adder 10 where one (1) is added to the signal, and the resultant signal is applied as a measure indication signal Q0′–Q4′ to a tempo/measure/beat indication circuit 18. The measure counter section 9 provides a signal 4*h* every four measures and a signal 8*h* every eight measures. These signals 4*h* and 8*h* are employed in the variation performance mode. The measure counter section 9 is so designed that, in the program mode or the program check mode, the measure number (count value) can be counted up or down without operating the beat counter section 4. A signal $\overline{O}$ outputted by the measure counter section 9 means that the count value of the measure counter section 9 is not zero (0). The signal $\overline{O}$ is used as a confirmation signal when the count value of the measure counter section 9 is decreased.

An end control circuit 11 functions mainly for the program performance mode. More specifically, the end control circuit 11 has a memory section. In the program mode, the last address of the program in the sequence memory (RAM) 7 is stored in the memory section. In the program performance mode, the last address of the program thus stored is compared with the output of the adder 10. When both coincide with each other, a coincidence signal A=B is outputted by the end control circuit 11, to initially reset the measure counter section 9. Thus, in the program performance mode, the contents programmed in the sequence memory (RAM) 7 are repeatedly read out, and the program performance is repeatedly carried out.

The pattern memory (ROM) 13 comprises a read-only memory (ROM). The pattern memory (ROM) 13 stores a plurality of performance patterns (such as patterns PT1, PT2, PT3 and Var) in correspondence to rhythms, and stores two measures of each of three kinds of fill-in patterns and three kinds of roll patterns. The performance patterns (pattern pulses) stored in the pattern memory (ROM) 13 are successively read out with the signal Q0 as an addressing signal among pattern selection data R0–R3, RV0, RV1, F0–F2 and FILLS provided by the pattern selection data selector 8, signals TC0–TC4 provided by the beat counter section 4, and the signals Q0–Q4 provided by the measure counter section 9. The pattern selection data R0–R3 provided by the selector 8 is used to indicate a kind of rhythm selected, the data RV0, RV1 indicates a specified pattern (one of the patterns PT1–PT3 and Var) in a kind of rhythm selected, the data F0–F2 indicates a selected fill-in pattern or a selected roll pattern, and the data FILS indicates whether or not the fill-in roll performance made is selected. The employment of the signal Q0 as the addressing signal among the signals Q0–Q4 provided by the measure counter section 9 relates to the fact that two measures of each performance pattern are stored in the pattern memory (ROM) 13. That is, when the signal Q0 is at "0", the performance pattern for the first measure is read out; and when the signal Q0 is at "1", the performance pattern for the second measure is read out.

The pattern memory (RAM) 14 comprises a random access memory (RAM) into which data can be loaded. The address arrangement of the pattern memory (RAM) 14 is similar to that of the pattern memory (ROM) 13, and accordingly the performance pattern (pattern pulse) stored therein is read out similarly as in the case of the pattern memory (ROM) 13.

The pattern setting switch matrix circuit 15 is to load the performance patterns into the pattern memory (RAM) 14. In the pattern setting switch matrix circuit 15, pattern setting switches are arranged in matrix form. A desired performance pattern can be set by suitably operating these switches.

A pattern pulse selector 16 operates to select pattern pulses read out of the pattern memory (ROM) 13 or pattern pulses read out of the pattern memory (RAM) 14, according to a signal ROM/RAM provided by the pattern selection data selector 8, and to apply the pattern pulse thus selected to a musical tone forming circuit 20 and a rhythm tone source circuit 21. The pattern pulse selector 16 is so designed that, when a break (pattern generation inhibition) specifying signal BRCS is outputted by the selector 8, delivery of the performance pattern to the musical tone forming circuit 20 and the rhythm tone source circuit 21 is inhibited. Furthermore, the pattern pulse selector 16 is so arranged that, upon depression of the ABC fill-in select switch (or the button 248 in FIG. 2) when the signal FILS indicative of the fill-in roll performance mode is being provided, delivery of a special pattern provided according to the selection of the fill-in pattern or the roll pattern to the musical tone forming circuit 20 can be inhibited. Upon depression of the switch matrix selection switch (corresponding to the button 252 in FIG. 2), the pattern pulse selector 16 selects the output of the pattern setting switch matrix circuit 15 and applies the output thus selected to the pattern memory (RAM) 14, so that a performance pattern selected by the pattern setting switch matrix circuit 15 is loaded into the pattern memory (RAM) 14.

Figure 9:
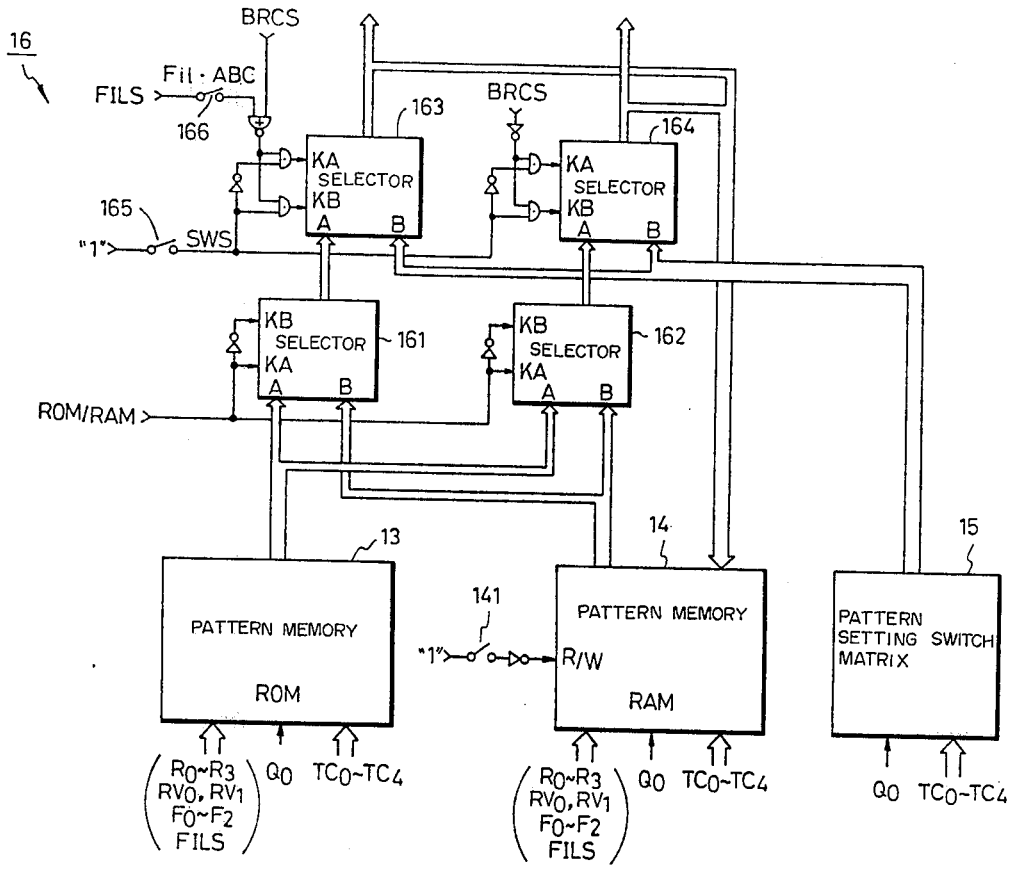
FIG. 9 is a circuit diagram illustrating the details of a pattern pulse selector in the device in FIG. 1.

The detail of the pattern pulse selector 16 is illustrated in FIG. 9 in relation with the pattern memory (ROM) 13, the pattern memory (RAM) 14, and the pattern setting switch matrix circuit 15.

The musical tone forming circuit 20 operates to form musical tones according to key depression in the keyboard section 19. The musical tone forming circuit 20 forms not only the musical tones of keys depressed in the keyboard section, but also automatic bass tones, automatic chord tones and automatic arpeggio tones according to bass patterns, chord patterns and arpeggio patterns applied from the pattern pulse selector 16. The bass pattern indicates degree intervals with respect to a root note (to be detected according to the notes of keys depressed in the keyboard), and the generation timings for the bass tones. According to the bass pattern, the musical tone forming circuit 20 forms musical tone signals constituting the root note and subordinate tones which are in predetermined interval relation with the root note, and outputs the musical tone signal with the generation timing of the bass pattern. The chord pattern indicates the generation timings of chord tones. The musical tone forming circuit 20 outputs according to the chord pattern musical tone signals constituting the chord tones which are formed by depressing keys in the keyboard. The arpeggio pattern indicates the order of tones which are to be produced among the tones of keys depressed, and the generation timings thereof are representative of the tone production timings of the arpeggio tones. The musical tone forming circuit 20 forms musical tones according to the arpeggio pattern and outputs them with the generation timing of the arpeggio pattern.

Although the details of the musical tone forming circuit 20 are not described in this specification, the automatic chord tone forming device may be similar to that disclosed in the specification of U.S. Pat. No. 4,228,712 entitled "Key Code Data Generator", and the automatic arpeggio tone forming device may be similar to that disclosed in the specification of U.S. Pat. No. 4,217,804 entitled "Electronic Musical Instrument with Automatic Arpeggio Performance Device".

A rhythm tone generator circuit 21 has a plurality of tone generator circuits which mainly produce tones of rhythm section (percussive instruments). The rhythm tone source circuit 21 receives a rhythm section pattern (pulses) among the performance patterns which are outputted by the pattern pulse selector 16, and controls the tone generator circuits according to the rhythm section pattern to form musical tone signals representative of rhythm section tones (percussive tones) corresponding to the rhythm section pattern.

The musical tone signals representative of key depression tones, automatic bass tones, automatic chord tones and automatic arpeggio tones from the musical tone forming circuit 20, and the musical tone signals representative of automatic rhythm section tones from the rhythm tone generator circuit 20 are subjected to resistance mixing and are then applied to amplifier 22, where they are suitably amplified. The musical tone signals thus amplified are produced by a loudspeaker 23.

Figure 10:
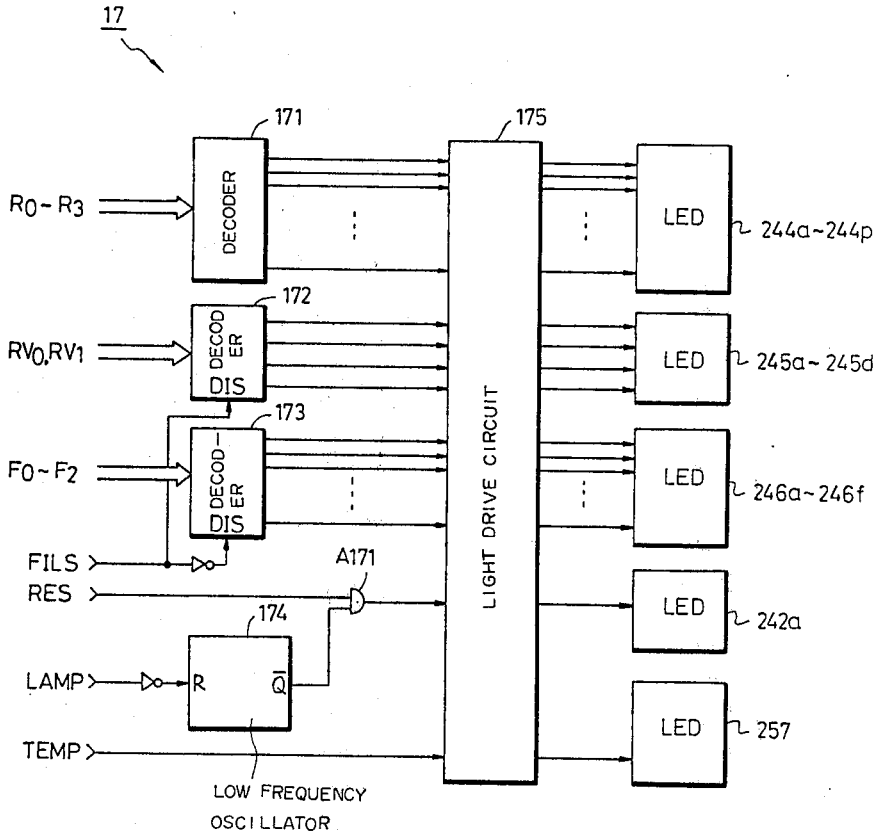
FIG. 10 is a block diagram showing the details of a lighting circuit in the device shown in FIG. 1.

A lighting circuit 17 operates to control the lighting of the light emission diode 242 near the button REC, the sixteen (16) light emission diodes 244*a* through 244*p* near the buttons of the rhythm selection button group 244, the four light emission diodes 245*a* through 245*d* near the buttons of the patterns specifying button group 245, the six (6) light emission diodes 246*a* through 246*f* near the buttons of the fill-in or roll pattern specifying button group 246, and the tempo indicating light emission diode 257. The details of the lighting circuit 17 is illustrated in FIG. 10.

Figure 11:
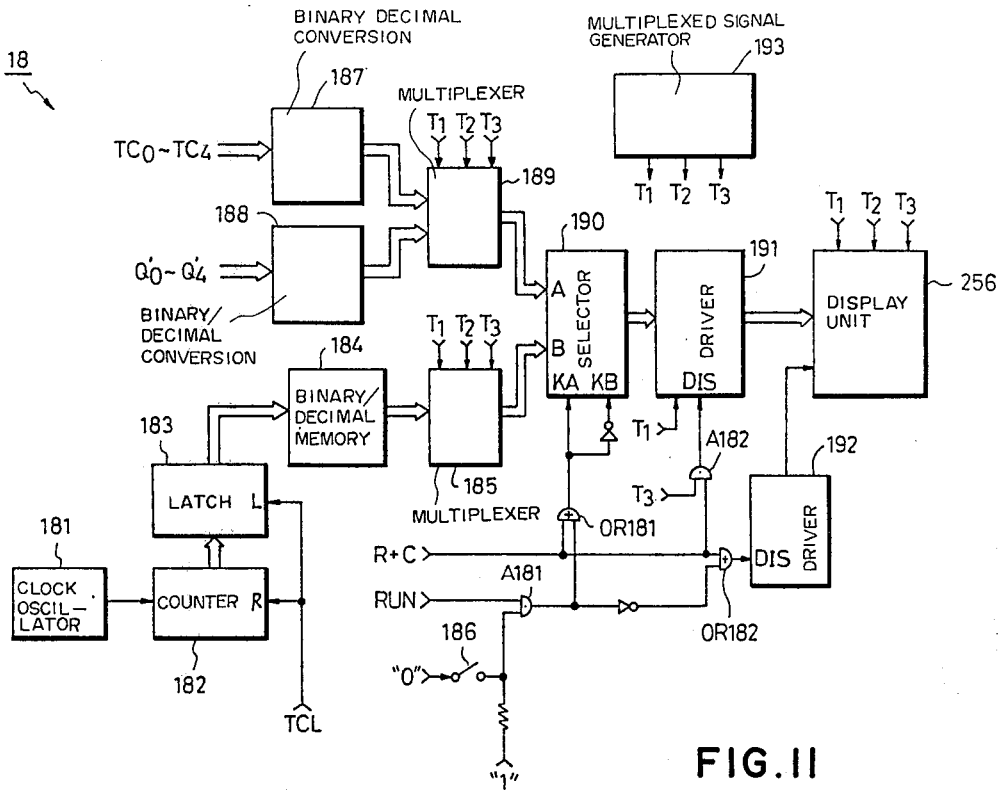
FIG. 11 is a block diagram showing the details of a tempo/measure/beat indication circuit in the device shown in FIG. 1.

A tempo/measure/beat indication circuit 18 is to control the numerical indication of tempo, measure number, and beat number of the tempo/measure/beat display unit 256. The details of the circuit 256 are illustrated in FIG. 11.

Figure 13:
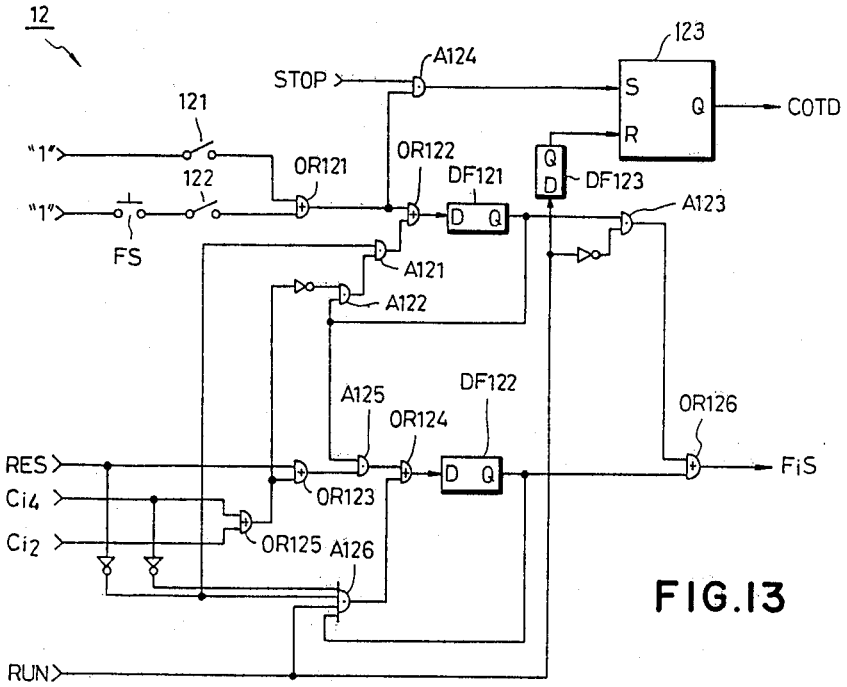
FIG. 13 is a circuit diagram showing the details of a fill-in control circuit in the device in FIG. 1.

A fill-in control circuit 12 functions in the fill-in/roll performance mode. This circuit 12 outputs a fill-in/roll performance mode specifying signal FiS which, after operation of the fill-in selection switch (corresponding to the button 247 in FIG. 2), rises in synchronization with the beat pulse Ci2 and falls in synchronization with the measure pulse Ci4. Furthermore, it should be noted that the fill-in control circuit 12 is so arranged that, where the fill-in selection switch is activated before a rhythm runs, it supplies a signal COTD to the measure counter 9 thereby to inhibit the measure pulse Ci4 from being applied to the measure counter section 9 at the same time the rhythm starts running. The details of the fill-in control circuit 12 is illustrated in FIG. 13.

Now, the operation modes will be described with reference to the detailed circuit diagrams.

Normal Performance Mode

In the normal performance mode, a performance pattern specified by the rhythm selection button group 244 and the pattern specifying button group 245 is repeatedly provided with two measures as one unit, whereby rhythm section tones, bass tones, chord tones or arpeggio tones are automatically and repeatedly produced with two measures as one unit.

In the normal performance mode, the buttons are operated as follows:

(1) The button NOR is depressed

One of the rhythm selection buttons 244 and one of the pattern specifying buttons 245 are selectively depressed.

The ROM/RAM change-over switch 251 is set to the ROM side or the RAM side.

(2) The start switch 249 or the synchronous start switch 250 is turned on.

When one of the buttons 241 (FIG. 2) is depressed, the remaining buttons 241 are automatically restored. That is, the button group 241 is of a mechanical lock-/release type. Therefore, when the button NOR is depressed, the remaining buttons Var4, Var8 and SEQ1 through SEQ3 are forcibly restored, whereupon in the mode selection switch circuit 1 (FIG. 3) switches 19 through 23 corresponding to the buttons Var4, Var8, and SEQ1 through SEQ3 are turned off. The button group 243 and the button group 242 in the panel section 24 (FIG. 2) are not depressed yet, the corresponding switches 11 through 18 in the mode selection switch circuit 1 (FIG. 3) are in "off" state. Accordingly, among signals outputted by the mode control signal forming circuit 2, only a signal $\overline{R+C}$ is raised to a logical level "1" (hereinafter referred to merely as "1" when applicable), and the remaining signals are at a logical level "0" (hereinafter referred to merely as "0" when applicable). The signal $\overline{R+C}$ is obtained by inverting a record or check process signal R+C outputted by an OR circuit OR2 which receives a signal from the switch 17 corresponding to the button CHECK and a signal from the switch 18 corresponding to the button RECORD.

When one of the rhythm selection buttons 244 and one of the pattern specifying buttons 245 are depressed and the ROM/RAM change-over switch 251 is set to the ROM side or the RAM side, then the pattern selection switch circuit 6 (FIG. 4) provides a rhythm selection data R0–R3 representing a rhythm selected, a pattern specifying data RV0, RV1 representing a specified pattern in a selected rhythm, and a ROM/RAM change-over signal ROM/RAM. The pattern selection switch circuit 6 (FIG. 4) is provided with sixteen (16) rhythm selection switches 61, four (4) pattern specifying switches 62, six (6) fill-in or roll pattern specifying switches 63 and one (1) ROM/RAM change-over switch 251 which correspond to the rhythm selection buttons 244, the pattern specifying buttons 245, the fill-in or roll pattern specifying buttons 246 and the RAM/ROM change-over switch 251 in the panel section 24 (FIG. 4) respectively. When one of the rhythm selection buttons 244 is depressed, then the corresponding one of the rhythm selection switches 61 is turned on, and the rhythm selection switch 61 provides a signal representative of the rhythm thus selected. The signal is encoded into a 4-bit rhythm selection data R0–R3 by an encoder 65, as indicated in Table 1 below for instance. As is clear from Table 1, the automatic performance device according to the invention can set sixteen kinds of rhythms, and only one of the sixteen rhythms is selected by a rhythm selection data R0–R3.

TABLE 1

| Rhythm | R3 | R2 | R1 | R0 |
|---|---|---|---|---|
| 1. March | 0 | 0 | 0 | 0 |
| 2. Waltz | 0 | 0 | 0 | 1 |
| 3. Swing | 0 | 0 | 1 | 0 |
| . | . | . | . | . |
| . | . | . | . | . |
| . | . | . | . | . |
| 15. Bossanova | 1 | 1 | 1 | 0 |
| 16. Samba | 1 | 1 | 1 | 1 |

When one of the pattern specifying buttons 245 is depressed, then the corresponding one of the pattern specifying switches 62 is turned on to output a signal representative of the pattern thus specified. The signal is applied to an encoder 66, where it is encoded into a 2-bit pattern specifying data RV0, RV1 which is outputted through OR circuits OR61 and OR62. One example of encoding in the encoder 66 is as indicated in Table 2. In the automatic performance device of the invention, four different patterns PT1, PT2, PT3 and Var are provided for each rhythm, and only one of the different patterns is selected by a pattern specifying data RV0, RV1.

TABLE 2

| Pattern | RV1 | RV0 |
|---|---|---|
| PT1 | 0 | 0 |

TABLE 2-continued

| Pattern | RV1 | RV0 |
|---|---|---|
| PT2 | 0 | 1 |
| PT3 | 1 | 0 |
| Var | 1 | 0 |

The ROM/RAM change-over switch 251 provides a signal "1" representative of the selection of the pattern memory (ROM) 13 when set to the ROM side, and provides a signal "0" representative of the selection of the pattern memory (RAM) 14 when set to the RAM side.

If, in this case, one of the fill-in or roll pattern specifying buttons 246 in the panel section 24 (FIG. 2) is depressed, then the corresponding one in the fill-in or roll pattern specifying switches 63 is turned on to provide a signal representative of the specified fill-in or roll pattern thus specified. This signal is applied to an encoder 67, where it is encoded into a 3-bit fill-in or roll pattern specifying data F0–F2, as indicated in Table 3 below:

TABLE 3

| Pattern | F2 | F1 | F0 |
|---|---|---|---|
| Roll 1 | 0 | 0 | 0 |
| Roll 2 | 0 | 0 | 1 |
| Roll 3 | 0 | 1 | 0 |
| Fil 1 | 0 | 1 | 1 |
| Fil 2 | 1 | 0 | 0 |
| Fil 3 | 1 | 0 | 1 |

In the normal performance mode, the fill-in select button 247 (FIG. 2) is not depressed, and therefore no fill-in signal FiS is provided by the fill-in control circuit 12 (FIG. 13) described later. Accordingly, no fill-in process signal FILS is produced by the mode control signal forming circuit 2 (FIG. 3), and therefore the fill-in or roll pattern specifying data F0–F2 is not employed in this case.

The rhythm selection data R0–R3, pattern specifying data RV0, RV1, fill-in or roll pattern specifying data F0–F2 and ROM/RAM change-over signal ROM/RAM produced by the pattern selection switch circuit 6 are applied to the pattern selection data selector 8.

The pattern selection data selector 8 has five selector units 81 through 85 which correspond to the rhythm selection data R0–R3, the pattern specifying data RV0, RV1, the fill-in or roll pattern specifying data F0–F2, the fill-in process signal FILS, and the ROM/RAM change-over signal ROM/RAM, respectively. Data from the pattern selection switch circuit 6 are applied to the input A of each selector unit (81–85), and data from the sequence memory (RAM) 7 are applied to the input B. The selector unit 81 through 85 are controlled by a sequence memory selection signal SEQS outputted by the mode control signal forming circuit 2 (FIG. 3). In the normal performance mode, the sequence memory selection signal SEQS is at "0" as described before. Therefore, the selectors 81 through 85 select the data from the pattern selection switch circuit 6, and accordingly the pattern selection data selector 8 outputs the data from the pattern selection switch circuit 6.

The data R0–R3, RV0, RV1, F0–F2, FILS and ROM/RAM provided by the pattern selection switch circuit 6 are further applied to the sequence memory (RAM) 7. However, in this operation, a load pulse signal LDP provided by the mode control signal forming circuit 2 (FIG. 3) is at "0", and therefore the sequence memory (RAM) 7 is not placed in loadable state yet; that is, no data from the pattern selection switch circuit 6 are loaded into the sequence memory (RAM) 7.

Upon depression of the synchronous start switch 250 or the start switch 249 in the panel section 24 (FIG. 2), a beat counter 41 in the beat counter section starts its operation.

First, the operation effected when the synchronous start switch 250 is operated will be described. When the synchronous start switch 250 and the start switch 249 of the start/stop control circuit 5 in FIG. 5 are off, both the synchronous start signal SST and the start signal ST provided by the switches 250 and 249 are at "0". As a result, the output of a NOR circuit NR51 receiving the two signals is at "1", and a flip-flop 51 is accordingly in reset state. On the other hand, a NOR circuit NR52 outputs a signal "1", which is applied to the load input L of the beat counter 41 in the beat counter section 4. Thus, all the bits of the beat counter 41 are forcibly set to "1".

When, under this condition, the synchronous start switch 250 is turned on to raise the synchronous start signal SST to "1", then the output of the NOR circuit 52 is set to "0", whereupon the beat counter 41 starts counting tempo pulses TCL generated by the tempo oscillator 3.

The tempo oscillator 3 operates to determine the tempo of the automatic performance, and is made up of a variable frequency oscillator. The frequency of the oscillator can be varied by operating a variable resistor 259 in the panel section 24 (FIG. 2).

The beat counter 41 counts the tempo pulse TCL outputted by the tempo oscillator 3 to vary parallel bit output signals TC0–TC4, to output a measure pulse Ci2 at the fall of the signal TC2, and to output a beat pulse Ci4 at the fall of the signal TC4. Before arrival of a key-on signal KTR from the keyboard section 19 although the synchronous start switch 250 has been maintained turned on, the AND circuit A51 of the start/stop circuit 5 remains disabled, and therefore the flip-flop 51 is not set. The key-on signal KTR provided by the keyboard section 19 is a signal which rises in synchronization with key depression in the keyboard section 19. When the flip-flop 51 is in reset state with the synchronous start switch 250 turned on, then the AND condition of an AND circuit A52 in the start/stop control circuit 5 is satisfied, as a result of which an AND circuit A41 in the beat counter section 4 is enabled by the output "1" of the AND circuit A52. Therefore, the beat pulse Ci2 produced by the beat counter 41 is outputted as the tempo signal TEMP through an OR circuit OR41, the AND circuit 41, and an OR circuit OR43. This tempo signal TEMP is used to control the lighting of a tempo indicating light emission diode 257 (FIG. 2) in a lighting circuit 17 (described later). The measure pulse Ci4 provided by the beat counter 41 is also outputted as the tempo signal TEMP through the OR circuits OR42 and OR43; however, this signal TEMP, being overlapped on the tempo signal TEMP attributing to the best pulse Ci2, does not appear in its own form.

In this operation, the flip-flop 51 in the start/stop control circuit 51 has been reset, and therefore the output of the OR circuit OR51 is at "0". Accordingly, no rhythm run signal RUN is outputted, but a rhythm stop signal STOP is outputted, to stop the automatic performance.

The reason why the beat counter section 4 is operated before the provision of the key-on signal KTR after the synchronous start switch 250 has been turned on is to produce the tempo signal TEMP which is used for tempo indication.

When key depression is effected in the keyboard section 19 to apply the key-on signal KTR to the start/-stop control circuit 5, the AND circuit A51 in the circuit 5 is enabled, whereby the flip-flop 51 is set, and the set output Q of the flip-flop 51 is outputted as the rhythm run signal RUN through the OR circuit OR51. This output of the OR circuit OR51 is subjected to rise differentiation in a differentiation circuit 52, the output of which resets the beat counter 41, i.e. all of the bits therein are set to "0", and simultaneously resets the tempo oscillator 3 to the initial state. On the other hand, the output of the differentiation circuit 52 is further applied to the OR circuits OR41 and OR42, so that the beat pulse Ci2 and the measure pulse Ci4 are outputted in synchronization with the start of the run of the rhythm. This is to eliminate the difficulty that, if the output signals TC2 and TC4 of the beat counter 41 are at "0", none of the beat pulse Ci2 and the measure pulse are produced.

When the flip-flop 51 in the start/stop control circuit 5 is set, the inversion output Q is set to "0". Therefore, the AND circuits A52 and A41 are disabled, and the measure pulse Ci4 is provided as the tempo signal TEMP through the OR circuits OR42 and OR43.

Figure 6:
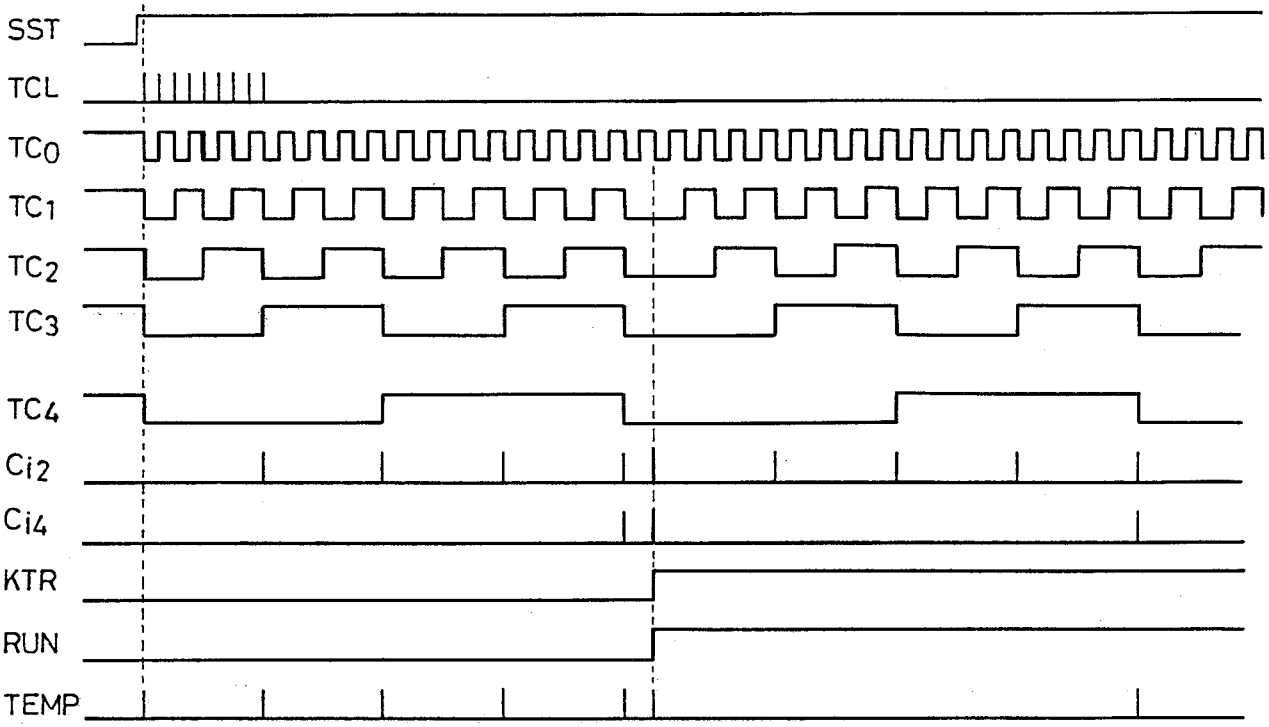
FIG. 6 is a timing chart for a description of the operation of the circuit shown in FIG. 5.

FIG. 6 is a timing chart of the various signals employed in the above-described operations. When the synchronous start signal SST is raised to "1" by turning on the synchronous start switch 250, the beat counter 41 starts its operation, and the bit output signals TC0 through TC4 vary as indicated in FIG. 6. The beat pulse Ci2 is produced at the fall of the signal TC2, and the measure pulse Ci4 is produced at the fall of the signal TC4. Furthermore, the beat pulse Ci2 is converted into the tempo pulse TEMP. When key depression is effected in the keyboard section 19 and the key-on signal KTR is raised to "1", the beat counter 41 is reset, as a result of which all of the bit output signals TC0 through TC4 are set to "0"and simultaneously the rhythm run signal RUN is raised to "1". In this operation, the beat pulse Ci2 and the measure pulse Ci4 are produced with the aid of the output of the differentiation circuit 52. The beat counter 41 starts its counting operation again, and in this case instead of the beat pulse Ci2, the measure pulse Ci4 appears as the tempo signal TEMP.

When the start switch 249 is turned on, the start signal ST is provided by the start switch 249, and is outputted as the rhythm run signal RUN through the OR circuit OR51. When this rhythm run signal RUN is outputted, the beat counter 41 and the tempo oscillator 3 are placed in the initial states by the output of the differentiation circuit 52, and the beat counter 41 in this initial state starts counting. The succeeding operation is the same as that in the case where the synchronous start switch 250 is turned on.

A switch 53 in the start/stop control circuit 5 corresponds to the start stop foot switch select button (FSS Start/Stop) 254 in the panel section 24 (FIG. 2). If the switch 53 is maintained turned on, then the start or stop of a rhythm is controlled by a foot switch FS. More specifically, the output of the switch 53 is applied to the input T of the flip-flop, and the signal at the input T is controlled by the foot switch FS, whereby the flip-flop 51 is set or reset, to control the start or stop of the rhythm.

Figure 7:
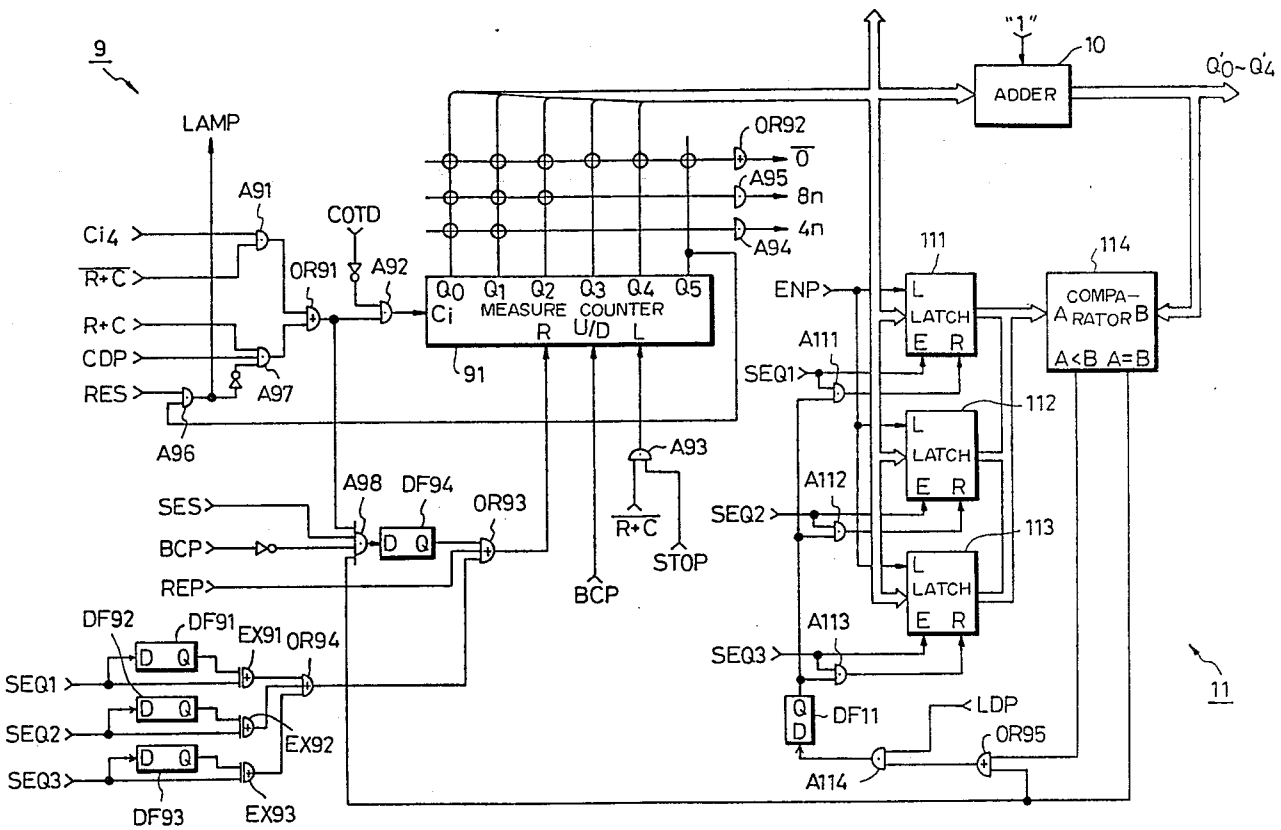
FIG. 7 is a circuit diagram showing the details of a measure counter section, an adder and an end control circuit in the device shown in FIG. 1.

As shown in FIG. 7, the measure counter section 9 comprises a 6-bit measure counter 91. All of the bits of the measure counter 91 are set to "1" by the output of an AND circuit A93 which is enabled by the signal $\overline{R+C}$ when the start/stop control circuit 5 (FIG. 5) is providing the rhythm stop signal STOP.

The measure pulse Ci4 from the beat counter 4 is applied to the count input Ci of the measure counter 91 through an AND circuit A91 which is enabled by the signal $\overline{R+C}$ and through an OR circuit OR91 and through an AND circuit A92 which is enabled by a signal which is obtained by inverting a signal COTD. This signal COTD is outputted by the fill-in control circuit 12 (FIG. 13) described later, and it is at "0" in this case. A back process pulse signal BCP is applied from the mode control signal forming circuit 2 (FIG. 3) to the up/down control terminal U/D of the measure counter 91. In this case, the signal BCP is at "0", and therefore the measure counter 91 is placed in up-count state.

Thus, the measure counter 91 conducts count-up operation in response to the measure pulse Ci4 applied by the beat counter section 4, and outputs parallel bit output signals Q0–Q5.

When both of the output signals Q0 and Q1 of the measure counter 91 are raised to "1", i.e. every fourth measures, the AND condition of an AND circuit A94 is satisfied, and therefore the AND circuit A94 outputs a signal 4*n*. When the output signals Q0, Q1 and Q3 are raised to "1", i.e. every eighth measures, the AND condition of an AND circuit A95 is satisfied, and the AND circuit A95 outputs a signal 8*n*. These signals 4*n* and 8*n* are utilized in the variation performance mode described later.

The remaining circuit elements in FIG. 7 will not be described here because they are not related directly to the normal performance mode.

The signals TC0–TC4 provided by the beat counter section 4 and the signal Q0 provided by the measure counter section 9 are applied, as dynamic addressing signals, to the pattern memory (ROM) 13, the pattern memory (RAM) 14, and the pattern setting switch matrix circuit 15, to successively read the performance patterns out of the addresses which are specified statically by the pattern selection data R0–R3, RV0, RV1, F0–F2 and FILS outputted by the pattern selection data selector 8. The performance patterns (bass patterns, chord patterns and arpeggio patterns) concerning accompaniment tone and the performance patterns (rhythm patterns) concerning rhythm tones are stored, with two measures as one unit, in the addresses specified by the pattern selection data R0–R3, RV0, RV1, F0–F2 and FILS, by utilizing the signals TC0–TC4, in the pattern memory (ROM) 13.

The arrangement of addresses in the pattern memory (RAM) 14 is similar to the arrangement of addresses in the pattern memory (ROM) 13, and predetermined performance patterns have been written in the pattern memory (RAM) 14. Writing the performance patterns into the pattern memory 14 is carried out by the pattern setting switch matrix circuit 15 in a pattern memory writing mode (described later).

A performance pattern read out of the pattern memory (ROM) 13 and a performance pattern read out of the pattern memory (RAM) 14 are applied to the pattern pulse selector 16, where one of the two performance patterns is selected according to the signal ROM/RAM from the pattern selection data selector 8.

The pattern pulse selector 16, as shown in FIG. 9, comprises selectors 161 and 162 each adapted to select one of the outputs of the pattern memories 13 and 14. More specifically, the selector 161 is adapted to select the performance patterns concerning accompaniment tones, and the selector 162 is adapted to select the performance patterns concerning rhythm tones.

The performance patterns read out of the pattern memory (ROM) 13 are classified into the performance pattern concerning accompaniment tones and the performance pattern concerning rhythm tones, and the performance patterns thus classified are applied to the inputs A of the selectors 161 and 162, respectively. Similarly, the performance patterns read out of the pattern memory (RAM) 14 are classified into the performance pattern concerning accompaniment tones and the performance pattern concerning rhythm tones, and the performance patterns thus classified are applied to the inputs B of the selectors 161 and 162, respectively.

It is assumed that the ROM/RAM change-over signal ROM/RAM is at "1". Then, the selectors 161 and 162 select a signal (which is a performance pattern read out of the pattern memory (ROM) 13) which is applied to the terminals A thereof. If the signal ROM/RAM is at "0", then the selectors 161 and 162 select a signal (which is a performance pattern read out of the pattern memory (RAM) 14) which is applied to the terminals B thereof. The outputs of the selectors 161 and 162 are applied to the inputs A of selectors 163 and 164, respectively.

The selectors 163 and 164 operate to select the output of the pattern memory (ROM) 13 or the pattern memory (RAM) 14 or the output of the pattern setting switch matrix circuit 15 according to the on-off operation of a switch matrix selection switch 165. Performance patterns set by the pattern setting switch matrix circuit 15, after being classified into one concerning accompaniment tones and one concerning rhythm tones, are applied to the inputs B of the selectors 163 and 164.

In the normal performance mode, the switch matrix selection switch 165 is off. Therefore, a switch matrix selection signal SWS of the switch 165 is at "0", and accordingly the selectors 163 and 164 select the performance pattern concerning accompaniment tones and the performance pattern concerning rhythm tones, respectively, which have been read out of the pattern memory (ROM) 13 or the pattern memory (RAM) 14.

The selectors 163 and 164 have functions of inhibiting the outputs by stopping the selection operations. More specifically, the selector 163 inhibits the output when the pattern selection data selector 8 provides a break process signal BRCS and when a fill-in process signal FILS is provided and a fill-in select switch 166 is on. The selector 164 inhibits the output when the break process signal BRCS is provided.

The outputs of the selectors 163 and 164 are applied to the musical tone forming circuit 20 and the rhythm tone generator circuit 21, respectively, as a result of which accompaniment tones (automatic bass tones, automatic chord tones, and automatic arpeggio tones) and rhythm tones are formed.

Thus, the bass tones, chord tones, arpeggio tones and rhythm tones are automatically produced repeatedly, as two measures as one unit, according to the performance pattern specified by the rhythm selection button group 244 and the pattern specifying button group 245.

Now, the indication (display) function will be described with reference to FIG. 10.

The pattern selection data R0–R3, RV0–RV1 and F0–F2 outputted by the pattern selection data selector 8 are applied to decoders 171, 172 and 173 in the lighting circuit 17 (FIG. 10). The decoder 171 decodes the data R0–R3 into sixteen (16) signals representative of rhythms, the decoder 172 decodes the data RV0–RV1 into four (4) signals representative of specified patterns, and the decoder 173 decodes the data F0–F2 into six (6) signals representative of fill-in patterns or roll patterns. In this connection, it should be noted that the operations of the decoders 172 and 173 are controlled by the fill-in process signal FILS provided by the pattern selection data selector 8. More specifically, when the fill-in process signal FILS is at "0", then the decoder 172 is enabled, but the decoder 173 is disabled; and when the signal FILS is at "1", then the decoder 172 is disabled, but the decoder 173 is enabled.

In the normal performance mode, the fill-in process signal FILS is at "0". Therefore, the decoder 172 is maintained enabled and the decoder 173 is maintained disabled. Accordingly, output signals are provided by the decoders 171 and 172 only, and are applied through a lighting means drive circuit 175 to the light emitting diodes **244*a* through 244*p* and the light emitting diodes 245*a* through 245*d***, so that a light emitting diode corresponding to a rhythm selection button depressed and a light emitting diode corresponding to a pattern specifying button depressed are caused to emit light.

The tempo signal TEMP from the beat counter section 4 is applied through the lighting means drive circuit 17 (FIG. 10) to the tempo indicating light emission diode 257. As was described before, the tempo signal TEMP is at "0" in a sense of direct current when both of the synchronous start switch 250 and the start switch 249 are turned off. Even if the synchronous start switch 250 has been turned off, the beat pulse Ci2 appears before a rhythm runs, and the measure pulse Ci4 appears when a rhythm is running. Thus, the lighting operation of the tempo indicating light emission diode 257 is as follows:

(1) When both of the synchronous start switch 250 and the start switch 249 are off—Lighted off.
(2) Before a rhythm runs with the switch 250 is on—Lighted on every beat.
(3) During the run of a rhythm—Lighted on every measure.

The tempo pulse TCL outputted by the tempo oscillator 3 and the parallel bit output signals TC0–TC4 of the beat counter 41 in the beat counter section 4 are applied to the tempo/measure/beat indicating circuit 18 (FIG. 11). The parallel bit output signals Q0–Q4 of the measure counter 91 in the measure counter section 9 are applied to the adder 10, where one (1) is added to the signal to provide the signals Q0′–Q4′, as described before. The signals Q0′–Q4′ is applied to the tempo/measure/beat indication circuit 18. The reason why one (1) is added to each of the parallel bit output signals Q0–Q4 in the adder 10 is that, otherwise, the count value of the measure counter 91 does not correspond to the measure number. As described before, the measure counter 91 starts the measure pulse Ci4 with all the bits thereof being "1". Therefore, the count value of the measure counter 91 is less by one (1) than the actual measure number. That is, it is necessary to add one (1) to the count value of the measure counter 91 in order that the count value of the measure counter 91 coincides with the actual measure number. For instance, at the first measure, the count value of the measure counter 91 is zero (0) in decimal notation. By adding one (1) to the count value, the value representing the first measure can be obtained.

In the tempo/measure/beat indicating circuit 18, a tempo, a measure number (the order of a measure) and a beat number (the order of a beat) are indicated on the display unit 256 (FIG. 2) according to the tempo pulse TCL, the signals TC0–TC4 and the signals Q0′–Q4′.

The tempo numerical indication will be described. Before a rhythm runs or when a tempo indication select switch 186 (corresponding to the tempo indication select button 258 in FIG. 2) is turned on, a tempo is indicated as a three-digit numeral by the display unit 256. In FIG. 11, a clock oscillator 181 is higher in oscillation rate than the tempo oscillator 3 (FIG. 1), and outputs a clock pulse having a predetermined frequency. The clock pulse outputted by the clock oscillator 181 is applied to a counter 182, where it is counted. The parallel bit output of the counter 182 is applied to a latch circuit 183, and the tempo pulse TCL is applied to the load control terminal of the latch circuit 183 and to the reset terminal R of the counter 182. Therefore, whenever the tempo pulse TCL is provided, the counter 182 is reset to start its counting operation. The content of the counter 182 at the time of generation of the tempo pulse TCL is transferred into the latch circuit 183 whenever the tempo pulse TCL is produced.

The numerical value thus transferred into the latch circuit 183 is inversely proportional to the tempo. The output of the latch circuit 183 is applied, as an addressing signal, to an inversely proportional (reciprocal) binary/decimal conversion memory 184. This memory 184 comprises a read-only memory (ROM) in which a value obtained by converting the reciprocal of a binary number into a decimal number is stored with the binary numbers as the addresses. The memory 184 subjects binary numbers applied thereto to inversely proportional conversion and binary/decimal conversion.

Thus, the memory 184 outputs a signal representative of a decimal number corresponding to the tempo. This signal is applied to a multiplex circuit 185, where it is multiplexed in time division manner for every digit with the aid of multiple signals T1, T2 and T3 from multiple signal generating circuit 193, so as to be applied to the input B of a selector 190.

In the normal performance mode, the record or check process signal R+C provided by the mode control signal generating circuit 2 (FIG. 3) is at "0". Therefore, when the output of an AND circuit A181 becomes "0", i.e. when the rhythm run signal RUN is at "0" or the tempo indication select switch 186 is turned on, the output of an OR circuit OR81 is set to "0", as a result of which the selector 190 selects the signal applied to its input B. The time division mulitplex decimal signal selected by the selector 190 is applied to the display unit 256 through a numeral light emission diode driver 191. When the most significant digit (the digit of the order of 100) of a value to be displayed is zero (0), the signal T1 applied to the numeral light emission diode driver 191 is used to inhibit the display of the value. The output of an AND circuit A182 receiving the signal T3 and the signal R+C is used to inhibit the display of the least significant digit (indicating a beat number in the program mode or in the check mode) in the program mode or in the check mode (describe later).

Figure 12:
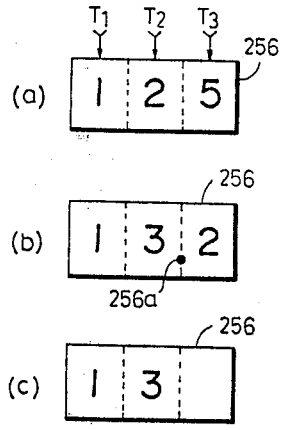
FIG. 12 is an explanatory diagram showing one example of displays on a display unit.

The display unit 256 is a three-digit light emission diode display unit, in which a signal applied is assigned with the aid of the signals T1, T2 and T3 to the light emission diodes provided respectively for the places of a display number, thereby to display the value of a tempo. One example of the digital display of the display unit 256 is as shown in the part (a) of FIG. 12, in which the numeral "125" means M.M ♩ =125.

The performance can vary the oscillation frequency of the tempo oscillator 3 (FIG. 1) by operating the tempo adjusting variable resistor 259 (FIG. 2) while referring to the tempo indicated on the display unit 256 before a rhythm runs. Therefore, he can set the tempo to a most suitable value. When a rhythm is running, the tempo is digitally displayed by operating the tempo indication select button 258, which makes it possible for the performer to confirm the tempo.

The display of a measure number and a beat number will be described.

During rhythm run, a measure number is displayed on the display unit 258 by using the first and second most significant digits, and a beat number is displayed by using the least significant digit. The signals TC0–TC4 outputted by the beat counter section 4 and the signals Q0′–Q4′ obtained by adding one (1) to the signals Q0–Q4 provided by the measure counter section 9 are applied to binary/decimal conversion circuits 187 and 188, where they are converted into signals representative of decimal numbers, which are applied to a multiplex circuit 189. The multiple signals T1–T3 are applied from the multiple signal generating circuit 193 to the multiplex circuit 189, so that the output of the circuit 187 is assigned in synchronization with the signal T3, and signals representative of the first digit and the tenth digit of the output of the circuit 188 are assigned in synchronization with the signals T2 and T3, respectively, whereby the outputs of the binary/decimal conversion circuits 187 and 188 are multiplexed in time division manner. The signal thus multiplexed in time division manner by the multiplex circuit 189 is applied to the input A of the selector 190.

As was described before, in the normal performance mode, the record or check process signal R+C is at "0". Therefore, when the rhythm run signal RUN is at "1", the tempo indication select switch 186 is in off state and the output of the AND circuit A181 is at "1", the output of the OR circuit OR181 is raised to "1". As a result, the selector 190 selects the signal applied to its input A.

The signal selected by the selector 190 is applied through the numeral light emission diode driver 191 to the display unit 256, and the digits displaying light emission diodes are allowed to emit light with the aid of the signals T1–T3. Thus, in the display unit 256, the least significant digit indicates the beat number, and the remaining digits indicate the measure number. When the output of the AND circuit A181 is at "1", then a decimal point light emission diode driver is enabled, as a result of which the decimal point light emission diode **256*a* (FIG. 2) provided between the least significant digit and the next digit in the display unit 256 is turned on. The decimal point in this display unit is not equal to the decimal point in decimal notation; that is, it is provided merely to distinguish the measure number indication and the beat number indication. One example of the indication effected by the display unit 256 is as shown in the part (b) of FIG. 12, in which the numeral 13** indicates the measure number, and the numeral 2 indicates the beat number.

Variation Performance Mode

In the variation performance mode, a performance pattern running in the normal performance mode is automatically switched over to a variation pattern at every fourth measure or at every eighth measure, so as to modify the automatic performance.

The button operation in the variation performance mode is the same as that in the normal performance except that instead of the button NOR in the button group 241 (FIG. 2) the button Var8 or Var4 is depressed.

More specifically, (1) The button Var4 or Var8 is depressed.

One of the rhythm selection buttons 244 and one of the pattern specifying buttons 245 are depressed.

The ROM/RAM change-over switch 251 is set to the ROM side or the RAM side.

(2) The synchronous start switch 250 or the start switch 249 is turned on.

When the button Var4 in the button group 241 is depressed, then the remaining buttons are returned automatically, and only the switch 19 corresponding to the button Var4 is turned on in the mode selection switch circuit 1 (FIG. 1). When the switch 19 is turned on, the mode selection switch circuit 1 provides a signal Var4, which is applied to an AND circuit A23 in the mode control signal forming circuit 2. Applied to the other input of the AND circuit A23 are the signal 4*n* which is provided by the measure counter section 9 (FIG. 7) and is raised to "1" for one measure per four measures, the rhythm run signal RUN provided by the start/stop control circuit 5 (FIG. 5), and a signal $\overline{\text{SEQ}}$ which is obtained by inverting the output signal SEQ of an OR circuit OR1 receiving the output signals SEQ-1–SEQ3 of the switches 21–23 in the mode selection switch circuit 1, and the logical expression is as follows:

$$4n \cdot \text{RUN} \cdot \text{SEQ} \cdot \text{Var4}$$

The AND condition of the AND circuit A23 is satisfied for one measure when the signal 4*n* is raised to "1", i.e. at every fourth measure, and the AND circuit A23 outputs a signal "1". This signal is outputted as a variation process signal VRS through an OR circuit OR21.

The variation process signal VRS provided by the mode control signal forming circuit 2 is applied to the OR circuits OR61 and OR62 in the pattern selection switch circuit 6 (FIG. 4). Therefore, as long as the variation process signal VRS is at "1", the output (pattern specifying data RV0, RV1) of the encoder 66 is forcibly converted into "1 1". As is indicated in Table 2, the case where the pattern specifying data RV0, RV1 is converted into "1 1" corresponds to the case where the variation pattern Var is specified. In other words, in the case where the button Var4 is depressed in the panel section 24, the pattern specifying data RV0, RV1 is changed at every fourth measure similarly as in the case where the variation pattern Var is specified.

Accordingly, in the case where one of the normal patterns PT1 through PT3 has been selected, the pattern is automatically changed to the variation pattern Var. at every fourth measure; that is, the pattern specifying data RV0, RV1 that the variation pattern Var is mixed for one measure per four measures is outputted by the pattern selection switch circuit 6.

When the button Var8 is depressed in the panel section 24 (FIG. 2), the switch 20 in the mode selection switch circuit 1 (FIG. 3) is turned on to provide the signal Var8 which is applied to the AND circuit A22 in the mode control signal forming circuit 2 (FIG. 3). The signals 8*n*, RUN and $\overline{\text{SEQ}}$ are applied to the other input of the AND circuit A22, and the logical expression is as follows:

$$8n \cdot \text{RUN} \cdot \overline{\text{SEQ}} \cdot \text{Var8}$$

The signal 8*n* is produced by the measure counter section 9 and is raised to "1" for one measure per four measures, as described before.

The AND condition of the AND circuit A22 is satisfied for one measure when the signal 8*n* is raised to "1", i.e. every fourth measure, and the AND circuit A22 provides a signal "1". This signal "1" is outputted as a variation process signal VRS through an OR circuit 21, whereby the processing is carried out similarly as in the case where the button Var4 is depressed.

Thus, when the button Var8 is depressed in the panel section 24, the pattern specifying data RV0, RV1 that the variation pattern Var is automatically mixed for one measure every eighth measure is outputted by the pattern selection switch circuit 6.

The pattern specifying data RV0, RV1 outputted by the pattern selection switch circuit 6 is applied as an addressing signal through the pattern selection data selector to the pattern memories 13 and 14. The succeeding operations are completely equal to those in the normal performance mode.

In the variation performance mode, even if the buttons corresponding to the normal patterns PT1–PT3 are depressed, the pattern specifying data RV0, RV1 provided by the pattern selection switch circuit 6 is changed to data "1 1" which automatically indicates the variation pattern at every fourth or eighth measure. Therefore, for one measure during which the pattern specifying data RV0, RV1 is changed to "1 1", the lighting circuit 17 turns on the light emission diode 245*d* near the button specifying the variation pattern instead of the light emission diodes near the depressed buttons.

Program Mode

The program mode is an operation mode for programming pattern progression. In this mode, the pattern progression is written in the sequence memory (RAM) 7 to make preparation for a program performance (described later). In the program mode, programming may be effected in thirty-two steps (corresponding to thirty-two measures) in maximum.

The button operation in the program mode is as follows:

(1) The button REC is depressed. One of the buttons SEQ1 through SEQ3 is selectively depressed.

(2) (1) In programming a main pattern:

One of the rhythm selection buttons 244, and one of the pattern specifying buttons 245 are depressed, and then the button LOAD is depressed.

(2) In programming a fill-in or roll pattern:

One of the fill-in or roll pattern specifying buttons 246 is depressed, and then the button LOAD is depressed with the fill-in select button 247 depressed.

(3) In programming a break pattern:

The button LOAD is depressed with the button BREAK depressed.

The above-described three button operations are carried out as desired.

(3) At the end of programming, the button END is depressed.

In the above-described operation, the ROM/RAM changeover switch 251 should be set to the ROM or RAM side. However, the programming may be achieved by including the operation of the ROM/RAM change-over switch 251 as one of the program conditions. In this case, the operation of the ROM/RAM change-over switch 251 is added for every loading operation.

When the button REC is depressed in the panel section 24, the corresponding switch 18 in the mode selection switch circuit 1 (FIG. 1) is turned on, and therefore the signal REC is provided by the mode selection switch circuit 1. This signal REC is outputted as a record process signal REC through the AND circuit A26 in the mode control signal forming circuit 2 (FIG. 3).

The record process signal RES is applied to an AND circuit A171 in the lighting circuit 17 (FIG. 10). The inversion output signal $\overline{Q}$ of a low frequency oscillator 174 is applied to the other input of the AND circuit A171. In this case, the signal $\overline{Q}$ is at "1". Therefore, the AND circuit A171 is enabled. Accordingly, the signal "1" is applied through a lighting means drive circuit 175 to the light emission diode 242*a* to turn on the latter 242*a*.

A signal REC* is obtained by subjecting the signal REC to rise differentiation in a rise differentiation circuit 30 in the mode selection switch circuit 1 (FIG. 3). The signal REC* is outputted as a reset pulse signal REP through an AND circuit A31 and an OR circuit OR22 in the mode control signal forming circuit 2. The signal REP is applied through an OR circuit OR93 in the measure counter section 9 (FIG. 7) to the reset terminal R of the measure counter 91, as a result of which all the bits in the measure counter 91 are set to "0". The signals Q0–Q4 of the output signals Q0–Q5 of the measure counter 91 are employed as addressing signals for the sequence memory (RAM) 7 (FIG. 4). The 0-th address in the sequence memory (RAM) 7 is first specified by the signals.

When one of the buttons SEQ1 through SEQ3 is depressed in the panel section 24 (FIG. 2), then the corresponding one of the switches 21 through 23 is turned on in the switch circuit 1 (FIG. 3), and therefore the corresponding one of the signals SEQ1 through SEQ3 is raised to "1". This signal (SEQ1–SEQ3) is applied to the sequence memory (RAM) 7 (FIG. 4) to specify an address in a memory region to be used for programming. The signal is further applied to the enable terminal E of the corresponding one of latch circuits 111 through 113 of the end control circuit 11 (FIG. 7), and only the corresponding latch is enabled.

In succession with this, the program (to write the pattern selection data into the sequence memory (RAM) 7 is carried out (put to practice). However, depending on the following cases, the operations are somewhat different:

(1) The case where the main pattern is programmed.

(2) The case where the fill-in or roll pattern is programmed.

(3) The case where the break pattern is programmed.

In the case where the main pattern is programmed, upon depression of one rhythm selection button 244 and one pattern specifying button 245, the rhythm selection data R0–R3 and the pattern specifying data RV0, RV1 are provided by the pattern selection switch circuit 6 (FIG. 4) and are applied to the sequence memory (RAM) 7.

The data R0–R3 and RV0, RV1 provided by the pattern selection switch circuit 6 are further applied to the pattern selection data selector 8. In the program mode, the rhythm run signal RUN is at "0", and therefore a sequence memory selection signal SEQS outputted by the mode control signal forming circuit 2 is at "0". Therefore, the pattern selection data selector 8 (FIG. 4) selects the A inputs (outputted by the pattern selection switch circuit 6). Accordingly, the data R0–R3 and RV0, RV1 applied to the selector 8 are selected so as to be applied to the lighting circuit 17. As a result, one of the light emission diodes 244*a* through 244*p* corresponding to the depressed rhythm selection button and one of the light emission diodes 245*a* through 245*d* corresponding to the depressed pattern specifying button are turned on.

Upon depression of the button LOAD in succession with this, the switch 14 in the mode selection switch circuit 14 is turned on. The output signal of the switch 14 is subjected to rise differentiation in the differentiation circuit 27, and is then applied, as a signal LOA*, to an AND circuit A28. The signals SEQ and REC are applied to the other input of the AND circuit A28, and the logical expression is as follows:

$$SEQ \cdot REC \cdot LOA^*$$

Thus, when the signal LOA* is provided, i.e. the button LOAD is depressed, the AND condition of the AND circuit A28 is satisfied, and the AND circuit A28 outputs a load pulse LDP. This load pulse LDP is applied through an inverter to a read/write control terminal R/W of the sequence memory (RAM) 7 to place the latter 7 to be in write state. Thus, the rhythm selection data R0–R3 and pattern specifying data RV0, RV1 provided by the pattern selection switch circuit 6 are written in the 0-th address of the region in the sequence memory (RAM) 7 which is specified by the signal (SEQ1–SEQ3).

The output signal LOA* of the differentiation circuit 27 (FIG. 3) is applied to an AND circuit A35. The signals SEQ and R+C are applied to the other input of the AND circuit A35, and the logical expression is as follows:

$$SEQ \cdot (R+C) \cdot LOA^*$$

Therefore, in this case, the AND circuit A35 is enabled; that is, the AND circuit A35 outputs a signal "1", which is provided as a measure counter drive pulse signal CDP through an OR circuit OR23, a 2-bit-time delay flip-flop DF21 and an OR circuit OR24.

This measure counter drive pulse signal CDP is applied to one input of an AND circuit A97 in the measure counter section 9 (FIG. 7). The record process signal RES provided by the mode control signal forming circuit 2 (FIG. 3) and the most significant bit output signal of the measure counter 91 are applied to an AND circuit A96. The output of the AND circuit A96 is applied through an inverter to a second input of the AND circuit A97, and the record or check process signal R+C provided by the mode control signal forming circuit 2 (FIG. 3) is applied to the remaining input of the AND circuit A97. In this case, the AND circuit A97 is enabled. Accordingly, the measure counter drive pulse signal CDP is applied through the AND circuit A97, an OR circuit OR91 and an AND circuit A92 to the count input Ci of the measure counter 91, to increase the count value of the latter 91. Thus, the next address is specified in the sequence memory (RAM) 7 (FIG. 4); that is, the sequence memory (RAM) 7 becomes ready for writing in the next step.

In programming the fill-in or roll pattern, first one of the roll pattern specifying buttons 246 is depressed. As a result, the roll pattern specifying data F0–F2 is outputted by the pattern selection switch circuit 6 and is applied to the sequence memory (RAM) 7.

The data F0–F2 is supplied through the pattern selection data selector 8 to the lighting circuit 17, so as to turn on one of the light emission diodes 246*a* through 246*f*, which corresponds to the depressed button.

In succession with this, the fill-in select button 247 is depressed, and a fill-in select switch 121 in the fill-in control circuit 12 (FIG. 13) is turned on, as a result of which a signal "1" is applied through OR circuits OR121 and OR122 to a delay flip-flop DF121. The output of the delay flip-flop DF121 is applied to an AND circuit A125. As the record process signal RES from the mode control signal forming circuit 2 is applied to the other input of the AND circuit A125, the latter A125 is enabled. Therefore, the output of the delay flip-flop DF121 applied to the AND circuit A125 is outputted through the latter A125 as it is, and is then delivered as a fill-in roll mode specifying signal FiS through an OR circuit OR124, a delay flip-flop DF122 and an OR circuit OR126.

The signal FiS from the fill-in control circuit 12 is applied to one input of an AND circuit A24 in the mode control signal forming circuit 2 (FIG. 3), and a signal $\overline{\text{CHE}}$ representing the fact that the mode is other than the check mode is applied to the other input of the AND circuit A24. Therefore, the AND circuit A24 is enabled to output the fill-in process signal FILS which is applied to the sequence memory (RAM) 7 through the pattern selection switch circuit 6.

When, under this condition, the button LOAD is depressed, the load pulse signal LDP is outputted by the mode control signal forming circuit 2 as described above. The load pulse signal LDP thus outputted places the sequence memory (RAM) 7 in writing state. Thus, the fill-in or roll pattern specifying data F0–F2 and the fill-in process signal FILS are written in the sequence memory (RAM) 7.

After the writing of the sequence memory (RAM) 7 has been done in response to the depression of the button LOAD, the measure counter drive pulse signal CDP is outputted by the mode control signal forming circuit 2 (FIG. 3) as described before, whereby the count value of the measure counter 91 (FIG. 7) is increased by one count.

In programming the break pattern, first the button BREK is depressed, and a switch 15 in the mode selection switch circuit 1 (FIG. 3) is turned on, as a result of which a signal BRE is applied to an AND circuit A25 in the mode control signal forming circuit 2 (FIG. 3). The signals SEQ and REC are applied to the other inputs of the AND circuit A25, and the logical expression is as follows:

SEQ·REC·BRE

Therefore, in this case, the AND condition of the AND circuit A25 is satisfied, and a break process signal BRCS is outputted by the AND circuit A25.

The signal BRCS is applied through the pattern selection switch 6 (FIG. 4) to the sequence memory (RAM) 7.

When, under this condition, the button LOAD is depressed, then the load pulse signal LDP is outputted by the mode control signal forming circuit 2 as was described above, thus placing the sequence memory (RAM) 7 in writing state. Thus, the break process signal BRCS is written in the sequence memory (RAM) 7.

In this case also, after the signal has been written in the sequence memory (RAM) 7, the measure counter drive pulse signal CDP is outputted by the circuit 2, whereby the content of the measure counter 91 is increased by one count.

In the automatic performance device of the invention, the break pattern has the first priority; that is, when the break process signal BRCS is outputted by the pattern selection data selector 8, a performance pattern outputted by the pattern pulse selector 16 is inhibited by the signal BRCS. Therefore, even if, in writing the break process signal BRCS into the sequence memory (RAM) 7, simultaneously the rhythm selection data R0–R3 and pattern specifying data RV0, RV1, or the fill-in or roll pattern specifying data F0–F2 or fill-in process signal FILS is written therein, no trouble is caused. In other words, the break pattern can be programmed with the relevant buttons in the rhythm selection button group 244, the pattern specifying button group 245 and the fill-in or roll pattern specifying button group 246 maintained depressed.

Furthermore, the pattern memory (ROM) 13 and the pattern memory (RAM) 14 are so designed that the fill-in pattern and the roll pattern are not read out thereof without the fill-in process signal FILS. Therefore, in programming the main pattern, no trouble is caused even if the relevant button in the fill-in or roll pattern specifying group 246 is maintained depressed.

The programming is advanced by repeating desired ones of the above-described operations. In this case, the program step (measure number) is displayed on the display unit 256 according to the signals Q0–Q4 from the measure counter 91 (FIG. 7). After one (1) is added to the signals Q0–Q4 outputted by the measure counter 91, the signals Q0–Q4 are applied to the binary/decimal conversion circuit 188 in the tempo/measure/beat indication circuit 18 (FIG. 11), where it is converted into a decimal number, which is applied through the multiplex circuit 189 to the A input of the selector 190. In this case, as the record or check process signal R+C produced by the mode control signal forming circuit 2 is applied to the selector 190, the latter 190 operates to select the A input. Accordingly, the signal applied to the A input is applied through the digital light emission diode driver 191 to the display unit 256, as a result of which the measure number is displayed by the first and second most significant digits on the display unit 256. In this operation, the AND circuit A182 is enabled by the record or check process signal R+C with the timing of the signal T3, to inhibit the display of the least significant digit (corresponding to the beat number) on the display unit 256, and the decimal point light emission diode driver is disabled, to inhibit the lighting of the decimal point indicating light emission diode 256*a*. One example of the display on the display unit 256 in the program mode is as shown in the part (c) of FIG. 12.

When the button END is depressed after the completion of the programming, the switch 16 in the mode selection switch circuit 1 (FIG. 1) is turned on. The output signal of the switch 16 is applied, as a signal END* subjected to rise differentiation in the differentiation circuit 28, to an AND circuit A29 in the mode selection signal forming circuit 2 (FIG. 3). The signals SEQ and REC are applied to the other input of the AND circuit A29, and the logical expression is as follows:

SEQ·REC·END*

Accordingly, in this case, the AND condition of the AND circuit A29 is satisfied, and the AND circuit A29 outputs an end pulse ENP. The end pulse ENP is applied to the load control terminals L of the latch circuits 111, 112 and 113 in the end control circuit 11 (FIG. 7). As was described above, only one of the latch circuits 111, 112 and 113 is enabled by the signal (SEQ1–SEQ3). Therefore, the count value (Q0–Q4) is loaded into the latch circuit with the aid of the end pulse ENP. In this operation, the count value of the measure counter 91 has been increased by one count by the measure counter drive pulse signal CDP from the mode control signal forming circuit 2 after the completion of the last program, and therefore the count value indicates an address next to the last address. This value corresponds to the measure number. In other words, a value equal to the last measure number programmed is loaded into the latch (111–113) in the end control circuit 11.

When the program of thirty-two steps (corresponding to thirty-two measures) is accomplished and the output signal Q5 of the measure counter 91 is raised to "1", then the signal Q5 is applied to an AND circuit A96 to enable the latter A96, whereby an AND circuit A96 is disabled to stop the count operation of the measure counter 91. The output of the AND circuit 96 is provided as a signal LAMP. The signal LAMP is applied through an inverter to the reset terminal R of a low frequency oscillator 174 in the lighting circuit 17 (FIG. 10), whereupon the low frequency oscillator 174 starts its operation. When the low frequency oscillator 174 starts its operation, then an AND circuit A171 is repeatedly rendered enabled and disabled, as a result of which a signal which is repeatedly set to "1" and "0" is provided by the AND circuit A171. As a result, the record indicating light emission diode 242 is turned on and off, thus informing the sequence memory (RAM) 7 of the fact that no program space is available.

In the program of the 32nd step (or 32nd measure) the content Q5–Q0 of the measure counter 91 is "0 1 1 1 1 1". In the adder 10, one (1) is added to the content 37 1 1 1 1 1" of from the 0-th bit (Q0) to the 4th bit (Q4) of the measure counter 91, and the resultant value "0 0 0 0 0" is outputted. This value represents the 32nd measure. The last measure number in the preceding program has been stored in the latches 111–113. This value represents a measure smaller than 32 measures or represents 32 measures. Accordingly, a comparator adapted to compare the content of the latches 111–113 with the output of the adder 10 outputs a coincidence signal A=B, or a signal A<B representing the fact that the output of the adder 10 is larger than the content of the latch circuits 111–113. In the comparator 114, the value "0 0 0 0 0" indicating the 32nd measure is handled as "1 1 1 1 1". The signal A=B or A<B outputted by the comparator 114 is applied through an OR circuit OR95 to one input of an AND circuit A114, to the other input of which is applied the load pulse signal LDP provided by the mode signal forming circuit 2 (FIG. 3). Therefore, the AND condition of the AND circuit A114 is satisfied when the button LOAD is depressed to program the 32nd step. The output of the AND circuit A114 is applied through a delay flip-flop DF111 to AND circuits A111 through A113, to the other inputs of which the signals SEQ1 through SEQ3 are applied, respectively. Accordingly, among the AND circuits A111 through A113, only one corresponding to an address in the sequence memory (RAM) 7, which performs programming is satisfied in its AND condition. The output of the AND circuit is applied to the reset terminal R of the corresponding latch to reset the content of the latter (the content being changed to "0 0 0 0 0". The value "0 0 0 0 0" represents the 32nd measure as was described before. Thus, when the program has been made up to the 32nd step, the same state as that in the case where the button END is depressed is automatically provided even if the button END is not depressed.

In the above-described program mode, the beat counter 41 (FIG. 5) is not operated, and therefore the dynamic addressing signals TC0–TC4 are not applied to the pattern memory (ROM) 13 and the pattern memory (RAM) 14. Therefore, the performance pattern is not read out (that is, no automatic performance is carried out).

Correction and addition of the program will be described.

In the case of partially correcting the program which has been loaded into the sequence memory (RAM) 7, the buttons are operated as follows:

(1) The button FOWARD, and the button BACK or RESET are operated to locate measures to be corrected, by referring to the display unit 256.

(2) The same operation as that in the programming operation is carried out.

When the button FOWARD is depressed in the panel section 24 (FIG. 2), a switch 11 in the mode selection switch circuit (FIG. 1) is turned on, as a result of which a signal FOW* is outputted by the rise differentiation circuit 24. The signal FOW* is applied to one input of an AND circuit A34 in the mode control signal forming circuit 2 (FIG. 3), to the other inputs of which are applied the signals SEQ and R+C. The logical expression of the AND circuit A34 is:

SEQ·(R+C)·FOW*

Therefore, in this case, the AND condition of the AND circuit A34 is satisfied, and a signal "1" is outputted by the AND circuit A34. This signal "1" is outputted as a measure counter drive pulse signal CDP through an OR circuit OR23, a 2-bit-time delay flip-flop DF21 and an OR circuit OR24, to increase the count value of the measure counter 91 (FIG. 7) by one count.

Upon depression of the button BACK, a switch 12 in the mode selection switch circuit 1 (FIG. 3) is turned on, and a signal BAC* is outputted by the rise differentiation circuit 25. This signal BAC* is applied to one input of an AND circuit A36 in the mode control signal forming circuit 2 (FIG. 3), to the other inputs of which are applied signals $\overline{O}$, SEQ and R+C. Thus, the logical condition is as follows:

$\overline{O}$·SEQ·(R+C)·BAC*

The signal $\overline{O}$ is the output of an OR circuit 92 in the measure counter section 9 (FIG. 7). When one of the bit outputs Q0 through Q5 of the measure counter 91 is at "1", the signal $\overline{O}$ is raised to "1", which indicates that the count value of the measure counter 91 is not zero (0). Therefore, in this case, the AND condition of the AND circuit A36 is satisfied under the condition that the count value of the measure counter 91 is not zero (0), and the AND circuit A36 provides a signal "1". This signal "1" is outputted as a back process pulse signal BCP. The signal BCP is outputted as a measure counter drive pulse signal CDP through an OR circuit OR24. The signal BCP is applied to the up/down control terminal of the measure counter 91 in the measure counter section 9 (FIG. 7), to place the measure counter 91 in count-down state. Therefore, the count value of the measure counter 91 is decreased by one count. The signal $\overline{O}$ is employed as a condition of generating the back process pulse signal BCP, because if the measure counter 91 is placed in step-down state when the count value of the measure counter 91 is zero (0), then the count value becomes unreasonable.

The back process pulse signal BCP is inverted into an inhibition signal which is applied to an AND circuit A98 in the measure counter section (FIG. 7). This is to ensure the step down from the last address in the program check mode (described later). In this program mode, the button REC has been depressed, and therefore an AND circuit A27 in the mode control signal forming circuit 2 (FIG. 3) has been disabled and a sequence process signal SES is at "0". Accordingly, the signal BCP is not used in the program mode.

When the button RESET is depressed, a switch 13 in the mode section switch circuit 1 (FIG. 3) is turned on, and therefore the rise differentiation circuit 26 outputs a signal RESE*. The signal RESE* is applied through an AND circuit A33 in the mode control signal forming circuit 2 (FIG. 3) to an OR circuit OR22, and the OR circuit OR22 provides a reset pulse signal REP. This signal REP is applied through an OR circuit OR93 in the measure counter section 9 (FIG. 7) to the reset terminal R of the measure counter 91, to reset the latter 91.

In other words, upon depression of the button FOWARD the count value of the measure counter is increased by one; while upon depression of the button BACK, the count value of the measure counter 91 is decreased by one. Upon depression of the button RESET, the count value of the measure counter 91 is reset to the initial one. For instance, if, when the button RESET is first depressed and the button FOWARD is depressed plural times to locate a measure to be corrected by referring to the display unit 256, the measure to be corrected has gone, then the button BACK should be depressed to set the count value of the measure counter 91 to a value corresponding to the measure to be corrected.

When the count value of the measure counter 91 has been set to the value corresponding to the measure to be corrected, then a correction program should be loaded. This operation is similar to that in the above-described programming. In other words, the correction program is loaded in predetermined addresses in the sequence memory (RAM) 7 by operating the rhythm selection button group 244, the pattern specifying button group 245 or the fill-in or roll pattern specifying button group 245, the fill-in select button 247 or the button BREAK or the button LOAD.

After the program has been loaded, programs can be added by operating the following buttons:

(1) The button FOWARD, the button BACK or the button RESET is operated suitably so that, the measure number is set to the number of a measure next to the last measure by referring to the display unit 256.

(2) Operation is carried out similarly as in the operations (2) and (3) in the programming.

The operations of the circuits of the device in the above-described operation (1) are similar to those in the operation (1) in the program correction. However, it should be noted that the operation in the program correction is to set the count value of the measure counter 91 (FIG. 7) to that corresponding to the measure to be corrected, while in the program addition, the count value of the measure counter 91 is set to that corresponding to a measure next to the last measure. That is, in the operation (1), the button FOWARD, the button BACK or the button RESET is suitably depressed, to increase or decrease or reset the count value of the measure counter 91, whereby the count value of the measure counter is set to that corresponding to a measure next to the last measure.

In succession with this, the rhythm selection button group 244, the pattern specifying button group 245 or the fill-in or roll pattern specifying button group 246, the fill-in select button 247 or the button BREAK are suitably depressed to select the first step pattern in the additional program. When, under this condition, the button LOAD is depressed, the mode control signal forming circuit 2 (FIG. 3) provides the load pulse signal LDP. Data representative of a pattern which has been selected by the load signal LDP are loaded in an address next to the program last address in the sequence memory (RAM) 7. The load pulse signal LDP is further applied to an AND circuit A114 in the end control circuit 11. In this case, the output of the adder 10 is greater than the value stored in the corresponding one of the latches 111, 112 and 113, and therefore the comparator 114 provides the signal $A<B$. Thus, the AND circuit A114 is enabled to output a signal "1". As a result, the value stored in the corresponding latch is reset.

The succeeding operation is completely similar to that in the programming.

If, after the programming, the program correction or the program addition, the button REC is depressed again, the button REC is restored. As a result, the switch 18 in the mode selection switch circuit 1 (FIG. 3) is turned off, and a fall differentiation circuit 31 outputs a signal $(R+C)^*$. This signal $(R+C)^*$ is applied to an OR circuit OR22 through an AND circuit A32 in the mode control signal forming circuit 2 (FIG. 3), as a result of which the reset pulse signal REP is outputted by the OR circuit OR22. Thus, the measure counter is reset for the initial state.

When the buttons SEQ1–SEQ3 are depressed newly to load another program into the sequence memory (RAM) 7, this change is detected by EXCLUSIVE OR circuits EX91 through EX93 which receive signals SEQ1, SEQ2 and SEQ3 and signals which are obtained by delaying the signals SEQ1, SEQ2 and SEQ3 with delay flip-flops DF91, DF92 and DF93, respectively. The outputs of the EXCLUSIVE OR circuits EX91 through EX93 are applied through OR circuits OR94 and OR93 to the reset terminal R of the measure counter 91. Thus, when the buttons SEQ1 through SEQ3 are depressed newly, the measure counter 91 is automatically reset to have the initial state.

Program Check Mode

In the program check mode, a programmed pattern is produced every measure to check the program.

The operation of buttons in the program check mode is as follows:

(1) The button CHECK is depressed.

One of the buttons SEQ1 through SEQ3 is depressed.

(2) The button FOWARD, the button BACK or the button RESET is operated to locate a desired measure while referring to a measure number displayed on the display unit 256.

(3) The start switch 249 is turned on.

In response to the depression of the button CHECK in the panel section 24 (FIG. 2), a corresponding switch 17 in the mode selection switch circuit 1 is turned on. As a result, the signal (R+C) provided by the mode selection signal forming circuit 2 (FIG. 3) is raised to "1", while the signal $\overline{R+C}$ is set to "0". The signal $\overline{R+C}$ is applied to an AND circuit A91 in the measure counter section 9 (FIG. 7), to disable the AND circuit A91. The signal R+C is applied to an AND circuit A97 to disable the latter A97.

When the switch 17 is turned on, the rise differentiation circuit 29 outputs a pulse signal CHE*, which is applied to an AND circuit A30 in the mode control signal forming circuit 2 (FIG. 3). A signal $\overline{REC}$ obtained by inverting the signal REC is applied to the other input of the AND circuit A30, and the logical expression is as follows:

$$\overline{REC}\cdot CHE^*$$

Therefore, in this case, the AND condition of the AND circuit A30 is satisfied, and the AND circuit A30 therefore outputs the reset pulse signal REP through the OR circuit 22, as a result of which the measure counter 91 (FIG. 7) is reset for its initial state.

When the buttons SEQ1 through SEQ3 are selectively depressed, an address is specified in the sequence memory (RAM) 7.

In succession with this, the button FOWARD, BACK or RESET is operated to locate a desired measure (to be checked). The operation in this case is similar to that according to the procedure (1) in the program correction.

In the program check mode, means for assuring step down when the count value of the measure counter 91 specifies the last address in the program is provided. The means is the back process pulse signal BCP which is applied through an inverter to an AND circuit A98 in the measure counter section 9 (FIG. 7). It is assumed that the back process pulse signal BCP is applied to the AND circuit A98. In this case, the count value of the measure counter 91 specifies the last address of the program. Thus, if the button BACK is depressed when the signal A=B has been provided by the comparator 114 in the end control circuit 11, then the output of the OR circuit OR91 is raised to "1" by the measure counter drive pulse signal CDP which is provided by the mode control signal forming circuit 2 in response to the depression of the button BACK. In this case, as the button REC is not depressed yet, and the sequence process signal SES from the mode control signal forming circuit 2 is at "1". Therefore, the AND condition of the AND circuit A98 is satisfied, and therefore the measure counter 91 is reset. That is, a difficulty is caused that, although the button BACK has been depressed to obtain an address immediately before the last address, the measure counter 91 is reset to zero (0).

However, if the back process signal BCP is applied through an inverter to the AND circuit A98, then the operation of the AND circuit A98 is inhibited. Thus, the above-described difficulty is not caused.

When the start switch 249 is depressed in succession with this, the beat counter 41 in the beat counter section 4 (FIG. 5) starts its operation similarly as in the normal performance mode described before. However, the AND circuit A91 in the measure counter section 9 (FIG. 7) has been disabled as described above, and therefore even if the measure pulse Ci4 is provided by the beat counter section 4, the measure counter 91 is not operated. That is, the count value of the measure counter 91 is maintained at the value set by the operation (2).

When the start/stop switch 249 is turned on as described above, the start/stop control circuit 5 (FIG. 5) produces the rhythm run signal RUN. This signal RUN is applied to an AND circuit A21 in the mode control signal forming circuit 2 (FIG. 2). The signals SEQ and $\overline{RUN}$ are applied to the other inputs of the AND circuit A21, and the logical expression is as follows:

$$RUN\cdot SEQ\cdot\overline{REC}$$

Therefore, in this case, the AND condition of the AND circuit A21 is satisfied, and the AND circuit A21 outputs the sequence memory selection signal SEQS through an AND circuit A37. The signal FILS which is raised to "1" in the fill-in mode is applied through an inverter to the other input of the AND circuit A37. Thus, the AND circuit A37 is enabled.

Upon provision of the sequence memory selection signal SEQS by the mode control signal forming circuit 2 (FIG. 3), the pattern selection data selector 8 (FIG. 4) selects the data (read out of the sequence memory (RAM) 7) applied to its B inputs. When the break process signal BRCS is read out of the sequence memory (RAM) 7, the signal BRCS is applied to a delay flip-flop DF81 through an AND circuit A81 which has been enabled by the sequence memory selection signal SEQS. The output of the delay flip-flop DF81 and the output of the AND circuit A81 are applied to an AND circuit A82. As the beat pulse Ci2 from the beat counter section 4 (FIG. 5) is applied to the delay flip-flop DF81, the break process signal BRCS is delayed by one beat. Accordingly, the break process signal BRCS is inhibited for the first beat in the pattern selection data selector 8; that is, for this period no break process signal BRCS is produced. This is a process according to a musical requirement, in which, in the case where the break pattern has been selected, no break (i.e., the inhibition of a performance pattern output) is carried out for the first beat only.

The output signals TC0–TC4 of the beat counter 41 and the output signal Q0 of the measure counter 91 are applied, as dynamic addressing signals, to the pattern memory (ROM) 13 and the pattern memory (RAM) 14. As was described before, the count value of the measure counter 91 has been fixed. Therefore, the signal Q0 is at "1" or "0". The signal Q0 at "1" represents and odd number measure, while the signal Q0 at "0" represents an even number measure.

Thus, a performance pattern for one measure is repeatedly read out of the pattern memory (ROM) 13 and the pattern memory (RAM) 14.

In this operation, the pattern selection data R0–R3, RV0,, RV1, F0–F2 and FILS from the sequence memory (RAM) 7 which have been selected by the pattern selection data selector 8 and the signal TEMP produced by the beat counter section 4 are applied to the lighting circuit 10 (FIG. 10). Therefore, the light emission diodes (244*a*–244*p*, 245*a*–245*d* and 246*a*–246*f*) corresponding to the pattern data R0–R3, RV0, RV1 and F0–F2 programmed for a measure to be checked are turned on. In addition, the tempo indicating light emission diode 257 is turned on in synchronization with the measure pulse Ci4.

In the tempo/measure/beat indication circuit 18 (FIG. 11), the selector 190 selects the A input side with the aid of the signal R+C which is produced by the mode control signal forming circuit 2. The signal R+C enables an AND circuit A182 to inhibit the indication of the first place (corresponding to the beat indication), while the output of an OR circuit OR182 disables a decimal point light emission diode driver 192 to inhibit the lighting of the decimal point light emission diode 256*a*. Accordingly, only the measure number being checked is displayed on the display unit 256.

Program Performance Mode

In the program performance mode, an automatic performance is repeatedly carried out according to the pattern advancement which has been programmed in the sequence memory (RAM) 7.

In the program performance mode, the buttons are operated as follows:

(1) One of the buttons SEQ1–SEQ3 is depressed.

(2) The synchronization start switch 250 or the start switch 249 is turned on.

When one of the buttons SEQ1–SEQ3 is depressed in the panel section 24 (FIG. 2), the signals SEQ1–SEQ3 are outputted by the mode control signal forming circuit 2 (FIG. 3), whereby a dynamic address is specified in the sequence memory (RAM) 7.

In succession with this, the synchronization start switch 250 or the start switch 249 is turned on. Then, in synchronization with or in asynchronization with a key depression the rhythm run signal RUN is provided by the start/stop control circuit 5 (FIG. 5), as a result of which the beat counter section 4 (FIG. 4) provides the measure pulse Ci4 to drive the measure counter 91 in the measure counter section 9 (FIG. 7). The above-described operation is completely equal to that in the case of the normal performance mode. The output signal Q0–Q4 of the measure counter 91 in the measure counter section 9 is applied as a dynamic addressing signal to the sequence memory (RAM) 7 (FIG. 9).

When the rhythm run signal RUN is produced by the start/stop control circuit 5, then the sequence memory selection signal SEQS is produced through an AND circuit A37 in the mode control signal forming circuit 2 (FIG. 3). As the signal SEQS is applied to pattern selection data selector 8, the latter 8 selects data applied to its B inputs, which are read out of the sequence memory (RAM) 7. Therefore, the pattern selection data selector 8 outputs the pattern selection data R0–R3, RV0, RV1, F0–F2, FILS, ROM/RAM and BREAK which are read out of the sequence memory (RAM) 7 for every measure.

The measure counter 91 in the measure counter section 9 (FIG. 7) counts the measure pulse Ci4 which is outputted by the beat counter section 4. The output of the adder 10, which is the sum of the count value of the measure count 91 and one (1), is applied to a comparator 114 in the end control circuit 11 (FIG. 7), where it is compared with the last measure number stored in the latch (111–113). As the signals SEQ1–SEQ3 are applied to the enable terminals E of the latch circuits 111–113, respectively, only the latch corresponding to the address specification is enabled. Thus, the output of the adder 10 is compared with the value stored in the latch thus enabled.

As is clear from the above description, when the count value of the measure counter 91 reaches the value corresponding to the last address of the program (which is less by one (1) than the last measure number of the program), the comparator 114 outputs the signal A=B. The signal A=B is applied to one input of an AND circuit A98 in the measure counter section 9 (FIG. 7). The sequence process signal SES produced by the mode control signal forming circuit 2 (FIG. 3), the inversion signal of the back process pulse signal BCP, the output of OR circuit OR91 are applied to the other inputs of the AND circuit A98. When the output of the OR circuit OR91 is raised to "1" (when the next measure pulse Ci4 is produced), the AND condition of the AND circuit A98 is satisfied, and the output "1" of the AND circuit A98 is therefore applied to the reset terminal R of the measure counter 91 through a delay flip-flop DF94 and an OR circuit OR93, to reset the measure counter 91.

As a result, the measure counter 91 starts its counting operation beginning with zero (0), again.

Figure 8:
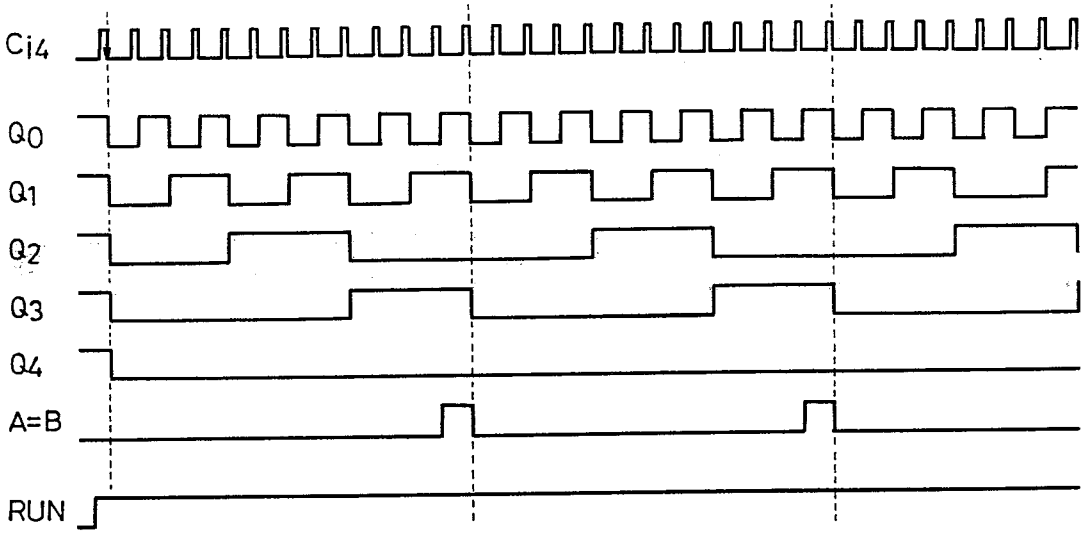
FIG. 8 is a timing chart for a description of the operation of the circuit shown in FIG. 7.

FIG. 8 is a timing chart indicating the operation of the measure counter 91 in the case where twelve (12) in decimal notation is stored as the last measure number in the end control circuit 11. Before the rhythm runs (RUN=0, and STOP=1), all the bits of the count value of the measure counter 91 are "1" with the aid of the output of an AND circuit A93 (FIG. 7) which receives the signal STOP and the signal $\overline{R+C}$. When the rhythm run signal RUN is raised to "1", the measure counter 91 starts counting the measure pulse Ci4 which is produced by the beat counter section 4. When the count value Q4–Q0 reaches "0 1 0 1 1" (11 in decimal notation), the comparator 114 in the end control circuit 11 outputs the signal A=4. As a result, the count value of the measure counter 91 is reset, whereby the measure counter 91 starts its counting operation beginning with zero (0). This operation is repeatedly carried out.

That is, the sequence memory (RAM) 7 is repeatedly addressed by the measure counter 91.

The following operation is completely equal to that in the normal performance mode. That is, the pattern memory (ROM) 13 and the pattern memory (RAM) 14 read a predetermined performance pattern with the pattern selection data R0–R3, RV0, RV1, F0–F2 and FILS outputted by the selector 8, the signal TC0–TC4 from the beat counter section 4 and the signal Q0 from the measure counter section 9 as addressing signals. The performance pattern thus read is suitably selected by the pattern pulse selector 16 and is then applied to the musical tone forming circuit 20 and the rhythm tone generator 21 to form accompaniment tones (bass, chord and arpeggio tones), whereby the automatic performance is carried out. The lighting circuit 17 turns on the light emission diodes 244*a*–244*p*, 245*a*–245*d* and 246*a*–246*f* corresponding to the pattern selection data outputted by the selector 18 and turns on and off the tempo indication light emission diode 257 according to the tempo signal TEMP produced by the beat counter section 4. On the other hand, the tempo/measured/beat indication circuit 18 displays the beam number and the measure number according to the signal TC0–TC4 outputted by the beat counter section 4 and the singal Q0′–Q4″ which is obtained by adding one (1) to the signal Q0–Q4 outputted from the measure counter section 9. The circuit 18 displays a tempo when required.

Pattern Memory Writing Mode

The pattern memory (RAM) 14 has been described under the condition that predetermined performance patterns have been stored therein. However, it should be noted that the writing into the pattern memory (RAM) 14 is carried out in the pattern memory writing mode described below:

In the pattern writing mode, a performance pattern set in the pattern setting switch matrix circuit 15 is writen in the pattern memory (RAM) 14.

The button operation in the pattern writing mode is as follows:

(1) The switch matrix selection button 252 is depressed.

(2) One of the rhythm selection buttons 244 and one of the pattern specifying buttons 245 are depressed, or one of the fill-in or roll pattern specifying buttons 246 is depressed and the fill-in select button 247 is depressed.

(3) The writing button 253 is depressed.

(4) The start switch 249 is turned on.

When the switch matrix selection button 252 is depressed in the panel section 24 (FIG. 2), the switch matrix selection switch 165 (FIG. 9) is turned on, as a result of which the selectors 163 and 164 are so switched as to select the signal applied to the B inputs (which are outputted by the pattern setting switch matrix circuit 15).

In the mode control signal forming circuit 2 (FIG. 3), the AND circuit A21 has been disabled. Therefore, the sequence memory selection signal SEQS is at "0", and the selector 8 (FIG. 4) is switched so as to select the signal (from the pattern selection switch circuit 6) applied to the A inputs.

When one of the rhythm selection buttons 244 and one of the pattern specifying buttons 245 are depressed, or one of the fill-in or roll pattern specifying buttons 246 and the fill-in select button 247 are depressed, then the corresponding switches in the pattern selection switch circuit 6 are turned on to provide the pattern selection data R0–R3, RV0, RV1, F0–F2 and FILS. The pattern selection data are applied through the selector 8 to the pattern memory (RAM) 14, to specify addresses for the pattern writing.

Upon depression of the writing button 253, the switch 141 (FIG. 9) is turned on, to place the pattern memory (RAM) 14 in writing state.

In succession with this, the start switch 249 is turned on, to cause the start/stop control circuit 5 (FIG. 5) to provide the rhythm run signal RUN. As a result, the beat counter 41 in the beat counter section 4 (FIG. 5) starts its operation, whereby the measure counter 91 in the measure counter section 9 (FIG. 7) is driven by the measure pulse Ci4 produced by the beat counter section 4. Before the rhythm run signal RUN is provided, all the bits of the content of the measure counter 91 have been set to "1" with the aid of the output of the AND circuit A93. Therefore, all the bits thereof are set to "0" upon provision of the rhythm run signal RUN, and the measure counter 91 starts its counting operation beginning with the first measure.

The signals TC0–TC4 from the beat counter section 4 and the signal Q0 from the measure counter section 9 are applied as dynamic addressing signals to the pattern memory (RAM) 14 and the pattern setting switch matrix circuit 15. As a result, the set performance pattern is read out of the pattern setting switch matrix circuit 15 by the two measures. The set performance pattern thus read is applied through the selectors 163 and 164 in the pattern pulse selector 16 (FIG. 9) to the pattern memory (RAM) 14, where it is written into the specified addresses. The pattern setting matrix circuit 15 comprises a switch matrix circuit whose address arrangement is similar to that of the pattern memory (RAM) 14 so as to enable to set the contents of the addresses by means of switches. A desired performance pattern is set in the circuit 15 by utilizing the switches, in advance.

Fill-in Roll Performance Mode

In the fill-in roll performance mode, during or before the normal performance mode or the program performance mode, a fill-in pattern or a roll pattern is inserted, so that an automatic performance is carried out according to the fill-in pattern or the roll pattern.

First, a "during-run" fill-in mode in which a fill-in pattern or a roll pattern is inserted while the normal performance mode or the program performance mode is being effected, will be described.

The "during-run" fill-in mode is effected by turning on the foot switch FS under the condition that the fill-in select button 247 is depressed or the fill-in foot switch select button 255 is depressed during the time that the normal performance mode or the program performance mode is being effected. In this case, one of the fill-in or roll pattern specifying buttons 246 has been depressed and a fill-in or roll pattern has been specified.

When the foot switch FS is turned on under the condition that the fill-in foot switch select button 255 is depressed or the fill-in foot switch select button 255 is depressed while the normal performance mode or the program performance mode is being effected, then a signal "1" is outputted by an OR circuit OR121 in the fill-in control circuit 12 (FIG. 13). In FIG. 13, a switch 121 corresponds to the fill-in select button 247, and a switch 122 corresponds to the fill-in foot switch select button 255.

The output signal "1" of the OR circuit OR121 is applied through an OR circuit OR122 to a delay flip-flop DF121. The output of the delay flip-flop DF121 together with AND circuits A122 and A121 form a feedback loop. The output of an OR circuit OR125, which receives the measure pulse Ci4 and the beat pulse Ci2 from the beat counter section 4, is applied through an inverter to the other input of the AND circuit A122. The record process signal RES from the mode control signal forming circuit 2 is applied through an inverter to the other input of the AND circuit A121. In this case, the signal RES is at "0", and therefore the AND circuit A121 is enabled, and the signal "1" applied to the delay flip-flop DF121 is self-held until the next measure pulse Ci4 and beat pulse Ci2 are provided. The output of the delay flip-flop DF121 is applied through an AND circuit A123 to an OR circuit OR126. However, in this case, the normal performance mode or the program performance mode is being effected, and therefore the rhythm run signal RUN from the start/stop control circuit 5 is at "1", and the AND circuit A123 is disabled. Accordingly, in this case, no fill-in signal FiS is not produced yet.

When the measure pulse Ci4 or the beat pulse Ci2 is provided by the beat counter section 4, this signal is applied through OR circuits OR125 and OR123 to an AND circuit A125 to enable the latter A125. As a result, the signal "1" stored in the loop including the delay flip-flop DF1 is applied through the AND circuit A125 and the OR circuit OR124 to a delay flip-flop DF122. On the other hand, the output of the OR circuit OR125 is applied through an inverter to the AND circuit A122 to disable the latter A122. Therefore, the data stored in the loop including the delay flip-flop DF121 is cleared.

The delay flip-flop DF122 has a feedback loop in which the output of the delay flip-flop DF122 is fed back to its input through the AND circuit A126. The inversion signal of the measure pulse Ci4, the inversion signal of the record process signal RES, and the rhythm run signal RUN are applied to the other inputs of the AND circuit A126. Accordingly, the delay flip-flop DF122 self-holds the signal "1" applied thereto until the succeeding measure pulse Ci4 is provided. The output of the delay flip-flop DF122 is outputted as the fill-in signal FiS through the OR circuit OR126.

Figure 14:
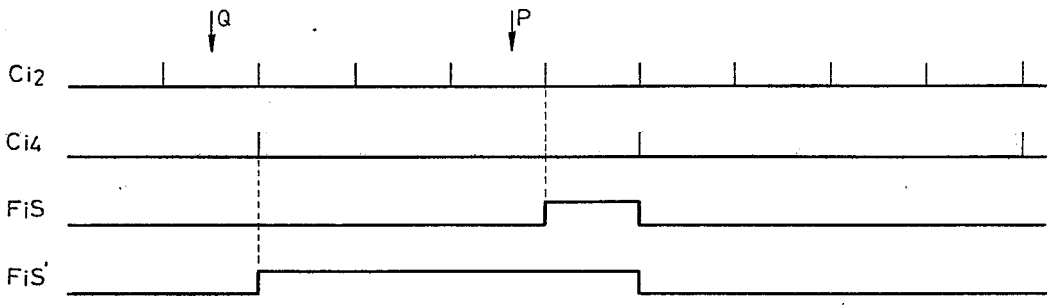
FIGS. 14 and 15 are timing charts for a description of the operation of the circuit shown in FIG. 13.

FIG. 14 is a timing chart indicating the above-described operation of the fill-in control circuit 12.

When, as shown in FIG. 14, the foot switch FS is turned on at the time instant P under the condition that the fill-in select button 247 is depressed or the fill-in foot switch select button 255 is depressed, then the fill-in signal FiS is obtained which rises with the following beat pulse Ci2 and falls with the measure pulse Ci4, being maintained at "1" for one beat period. When the foot switch FS is turned on at the time instant Q under the condition that the fill-in select button 247 is depressed or the fill-in foot switch select button 255 is depressed, then the fill-in signal FiS' is obtained which rises with the following measure pulse Ci4, being maintained at "1" for one measure period.

The fill-in signal FiS outputted by the fill-in control circuit 12 is supplied to the mode control signal forming circuit 2 (FIG. 3), to enable the AND circuit A24, thereby to produce the fill-in process signal FILS. The fill-in process signal FILS is applied through the pattern selection switch circuit 6 (FIG. 4) to the A inputs of the pattern selection data selector 8.

The output of the AND circuit A24 in the mode control signal forming circuit 2 (FIG. 3) is applied through an inverter to an AND circuit A37 to disable the latter A37. As a result, the sequence memory selection signal SEQS produced through the AND circuit A37 is forcibly set to "0". That is, in the normal performance mode, the sequence memory selection signal SEQS is at "0", and therefore the sequence memory selection signal SEQS is maintained at "0" even if the fill-in process signal FILS is provided; however, in the program performance mode, the sequence memory selection signal SEQS is at "1", and when the fill-in process signal FILS is provided, then the sequence memory selection signal SEQS is forcibly set to "0", as a result of which the pattern selection data selector 8 is switched to select the A inputs (the output of the rhythm selection switch circuit 6).

Thus, the fill-in process signal FILS is applied to the pattern memory (ROM) 13 and the pattern memory (RAM) 14, to change the reading address to an address corresponding to the fill-in or roll pattern.

In response to this address changed, the fill-in or roll pattern is read out of the pattern memory (ROM) 13 and the pattern memory (RAM) 14. the pattern thus read is applied through the pattern pulse selector 16 to the musical tone forming circuit 20 and the rhythm tone generator 21, to change the automatic accompaniment tones and rhythm tones (into musical tones essentially of drum solo, musical tones of snare drum continuous percussion, or so).

When the fill-in signal FiS from the fill-in control circuit 12 is set to "0", then the fill-in process signal FILS from the mode control signal forming circuit 2 (FIG. 3) is also set to "0", and the original state is obtained (i.e. the mode is returned to the normal performance mode or the sequence performance mode).

In the fill-in roll performance mode, the fill-in process signal FILS disables the decoder 172 in the lighting circuit 17 (FIG. 10) and instead enables the decoder 173. Therefore, one of the light emission diodes 245*a*–245*d* corresponding to the pattern specifying buttons 245 is turned off, while one of the light emission diodes 246*a*–246*f* corresponding to the fill-in or roll pattern specifying buttons 246 is turned on.

An intro (introduction) fill-in mode, in which a fill-in pattern or a roll pattern is inserted before the normal performance mode or the program performance mode is effected, will be described.

The intro fill-in mode is effected by turning on the foot switch FS under the condition that the fill-in select button 247 is depressed or the fill-in foot switch select button 255 is depressed before the normal performance mode or the program performance mode is effected.

When the foot switch FS is turned on with the button 247 or the button 255 depressed, then the OR circuit OR121 outputs a signal "1". This signal "1" is applied through the OR circuit OR122 to the delay flip-flop DF121, and is self-held by the AND circuits A122 and A121. The output of the OR circuit OR121 is applied to one input of the AND circuit A124, to the other input of which is applied the stop signal STOP provided by the start/stop control circuit (FIG. 5). In this case, the rhythm is not started yet. Therefore, the stop signal STOP is at "1", which enables the AND circuit A124. The output of the AND circuit A124 is applied to a flip-flop 123, to set the latter 123, as a result of which a signal COTP is outputted by the flip-flop 123. This signal COTP is applied through an inverter to the AND circuit A92 in the measure counter section 9 (FIG. 7), to disable the AND circuit A92.

When the start switch 249 is turned on, similarly as in the normal performance mode or the program performance mode the rhythm run signal RUN is outputted by the start/stop control circuit 5 (FIG. 5) and the beat counter 41 in the beat counter section 4 (FIG. 5) provides the beat pulse Ci2 and the measure pulse Ci4 in sychronization with the generation of the rhythm run signal RUN. However, as the AND circuit A92 in the measure counter section 9 (FIG. 7) has been disabled as was described above, the measure counter 91 does not start its operation yet (all the bits thereof being maintained at "1").

The rhythm run signal RUN generated by the start/-stop circuit 5, after being delayed by the delay flip-flop DF123, is applied to the reset terminal R of the flip-flop 123. Thus, the flip-flop 123 is reset in a predetermined period of time after the rhythm run signal RUN was generated, so that the signal COTD is set to "0" and the AND circuit A92 in the measure counter section 9 is enabled.

The beat pulse Ci2 and the measure pulse Ci4 provided in synchronization with the rhythm run signal RUN by the measure counter section 4 are applied through an OR circuit OR125 to an AND circuit A125 to enable the latter A125, so that the signal "1" held in the delay flip-flop DF121 is transferred into the delay flip-flop DF122. The delay flip-flop DF122 holds this signal "1" until the succeeding measure pulse Ci4 is provided, and the delay flip-flop DF122 outputs the signal FiS through the OR circuit OR126.

The operation of generating a fill-in pattern or a roll pattern according to the signal FiS is similar to that in the above-described "during run" fill-in mode.

When the second measure pulse Ci4 is produced by the beat counter section 4, the signal held in the delay flip-flop DF122 is cleared, and the fill-in signal FiS is set to "0". As was described above, the flip-flop 123 has been reset by the signal obtained by delaying the rhythm run signal RUN and the AND circuit A92 in the measure counter section 9 (FIG. 7) has been enabled, and therefore the measure counter 91 starts its operation. As a result, the normal performance mode or the program performance mode is started with the first measure.

That is, the fill-in pattern or the roll pattern is inserted immediately before the normal performance mode or the program performance mode is effected, so that the performance according to the fill-in pattern or the roll pattern is carried out before the normal performance mode or the program performance mode is effected.

Figure 15:
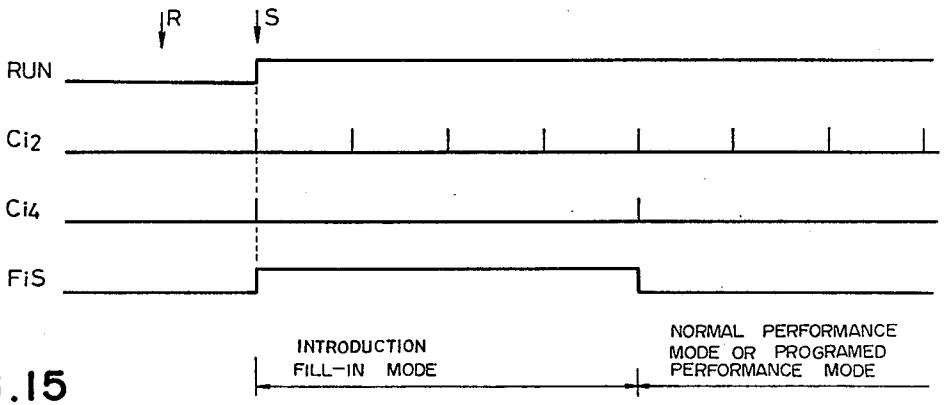

FIG. 15 is a timing chart indicating the above-described operation of the intro. fill-in mode. Where the foot switch FS is turned on at the time instant R under the condition that the fill-in select switch 247 is depressed or the fill-in foot switch select switch 255 is depressed and the start switch 249 is turned on at the time instant S, the fill-in signal FiS rises in synchronization with the depression of the start switch 249 and falls to "0" in one measure period. That is, during the time that the fill-in signal FiS is at "1", the intro. fill-in mode according to the fill-in pattern or the roll pattern is effected, and in succession with this the normal performance mode or the program performance mode is effected.

In the fill-in control circuit 12 in FIG. 13, the AND circuit A13 has a function of turning on the light emission diodes 246*a*–246*f* indicating a fill-in pattern or a roll pattern before the rhythm performance starts. More specifically, if the signal "1" is loaded in the delay flip-flop DF121, then before the rhythm runs the AND circuit A123, is enabled to apply the signal "1" to the OR circuit OR126, so that the fill-in signal FiS is provided by the OR circuit OR126. As a result, the mode control signal generating circuit 2 provides the fill-in process signal FILS, which is applied through the pattern selection switch circuit 6 and the pattern selection data selector 8 to the lighting circuit 17 (FIG. 10) to enable the decoder 173, thereby to turn on one of the light emission diodes 246*a*–246*f*, which corresponds to the specified pattern.

As is clear from the above description, according to the invention, pattern progression can be programmed as desired, and therefore rhythm section tones or accompaniment tones rich in variation can be automatically performed. Measure numbers are indicated in the program mode, which facilitates the programming operation. Furthermore, as the program content of a particular measure is repeatedly read out, the confirmation of the program can be readily achieved.

What is claimed is:

1. An automatic performance device comprising:
   - a pattern memory for storing a plurality of performance patterns;
   - a sequence memory for storing a pattern progression sequence which defines a sequential order of the patterns to be performed;
   - performance pattern reading means for successively reading respective ones of said performance patterns stored in said pattern memory in accordance with the pattern progression sequence stored in said sequence memory; and
   - musical tone forming means for forming musical tones for automatic performance in accordance with the performance patterns read out of said pattern memory.

2. A device as claimed in claim 1, in which said sequence memory is adapted to successively store pattern selection data selecting one of the plurality of performance patterns stored in said pattern memory.

3. A device as claimed in claim 1, in which said pattern memory is adapted to store plural kinds of performance patterns.

4. A device as claimed in claim 3, in which said each of said performance patterns is a performance pattern for at least one measure.

5. A device as claimed in claim 1, in which said performance pattern reading means operates to successively select one of the plurality of performance patterns stored in said pattern memory in response to an output of said sequence memory, to read a desired performance pattern.

6. A device as claimed in claim 2, in which said performance pattern reading means comprises: a first counter which is driven by a tempo pulse having a frequency corresponding to a tempo; and a second counter which is driven by a carry signal outputted by said first counter, so that said pattern selection data are read out of said sequence memory with an output of said second counter as an addressing signal, a corresponding performance pattern among the plurality of performance patterns stored in said pattern memory is selected according to said pattern selection data thus read, and said performance pattern thus selected is read with an output of said first counter as an addressing signal.

7. A device as claimed in claim 6, which further comprises:
   - means for forming a tempo digital display signal representing a tempo according to said tempo pulse;
   - means for forming a rhythm advancement state digital display signal representing a rhythm advancement state in accordance with outputs of said first and second counters;
   - a display unit; and
   - display signal selecting means for selectively carrying out switching operation so that, under the condition that a rhythm is stopped, said tempo digital display signal is applied to said display unit and, under the condition that a rhythm is running, said rhythm advancement state digital display signal is applied to said display unit.

8. A device as claimed in claim 7, in which said rhythm advancement state digital display signal comprises an advancement measure digital display signal representing an advancing measure according to an output from said second counter and an advancement beat digital display signal representing an advancing beat according to an output of said first counter, to digitally display an advancing measure and an advancing beat simultaneously on said display unit.

9. A device as claimed in claim 8, in which said display unit comprises means for displaying a decimal point for distinguishing an advancing measure and an advancing beat from each other in displaying said advancing measure and advancing beat.

10. A device as claimed in claim 7, in which said display signal selecting means comprises a tempo display forcing switch for carrying out switching selection so that under the condition that said tempo display forcing switch is turned on, said tempo digital display signal is applied to said display unit.

11. An automatic performance device comprising:

a pattern memory for storing a plurality of performance patterns;

a sequence memory for storing a pattern progression sequence which defines a sequential order of the patterns to be performed;

programming means for programming said pattern progression sequence to be stored in said sequence memory;

performance pattern reading means for successively reading respective ones of said performance patterns stored in said pattern memory according to the pattern progression sequence stored in said sequence memory; and musical tone forming means for forming musical tones for automatic performance according to the performance patterns read out of said pattern memory.

12. A device as claimed in claim 11, in which said programming means comprises: a group of pattern selection switches for selecting one out of a plurality of performance patterns; and means for stepping an address in said sequence memory in correspondence to performance pattern selection by said group of pattern selection switches, said programming means successively writing pattern selection data selected by said group of pattern selection switches into addresses in said sequence memory.

13. A device as claimed in claim 11, in which said programming means comprises: a break switch; and means for writing a break signal into said sequence memory when said break switch is operated, and said reading means comprises means for inhibiting outputting a performance pattern read out of said pattern memory under the condition that said break signal is read out of said sequence memory.

14. A device as claimed in claim 13, which further comprises: means for inhibiting said break signal read out of said sequence memory.

15. A device as claimed in claim 11, in which said programming means comprises: a program ending switch; and memory means for storing an addressing signal to said sequence memory when said program ending switch is operated, and said reading means comprises: means which compares the content of said memory means with an addressing signal accompanying pattern progression, and when both coincide with each other, resets said pattern progression to an initial state thereof.

16. A device as claimed in claim 12, in which said programming means further comprises: means for detecting the overflow of said address in said sequence memory to indicate said overflow of said address.

17. A device as claimed in claim 11, in which said programming means further comprises program check means for stopping a pattern progression and repeatedly reading addresses corresponding to said pattern progression thus stopped out of said pattern memory.

18. A device as claimed in claim 17, in which said program check means has display means for displaying said pattern progression thus stopped.

19. A device as claimed in claim 11, in which said programming means further comprises: display means for displaying a program advancement in correspondence to program writing.

20. An automatic performance device comprising: a pattern memory for storing a plurality of performance patterns; means for generating pattern selection data for selecting one performance pattern out of said plurality of performance patterns stored in said pattern memory; a tempo oscillator for producing a tempo pulse having a frequency corresponding to a tempo; and counter means which is driven by said tempo pulse, to form an addressing signal for said pattern memory, so that a performance pattern selected by said pattern selection data is read according to an output of said counter means, and an automatic performance is carried out according to said performance patterns thus read; which device further comprises:

particular measure detecting means for detecting a particular measure; and pattern changing means for changing said pattern selection data according to a detection output of said particular measure detecting means, so that an automatic performance change every particular measure is carried out.

21. A device as claimed in claim 20, in which said particular measure detecting means operates to periodically detect a measure occurring every predetermined measure number as said particular measure, according to a partial bit output of said counter means.

22. A device as claimed in claim 20, in which said pattern changing means is a logical circuit adapted to forcibly change said pattern specifying data into a predetermined pattern specifying data in accordance with a detection output of said particular measure detecting means.

23. An automatic performance device comprising: a pattern memory for storing a plurality of performance patterns; a tempo oscillator for producing a tempo pulse having a frequency corresponding to a tempo; a counter which is driven by said tempo pulse, to form an addressing signal for said pattern memory, so that one performance pattern among said plurality of performance patterns stored in said pattern memory is read out according to an output of said counter; and a tone producing circuit for producing tones according to said performance pattern thus read, which device further comprises:

fill-in signal generating means for generating a fill-in signal; and switching means for switching a performance pattern read out of said pattern memory into a different performance pattern under the condition that said fill-in signal is generated.

24. A device as claimed in claim 23, in which said switching means comprises:

a first memory for receiving said fill-in signal and holding said fill-in signal until a first timing signal is produced in response to an output of said counter;

a second memory for receiving contents of said first memory with said first timing signal and holding said contents until a second timing signal is produced in response to an output of said counter; and means for switching a performance pattern read out of said pattern memory into a different performance pattern with an output of said second memory as a condition.

25. A device as claimed in claim 24, in which said first timing signal corresponds to beats, while said second timing signal corresponds to measures.

26. A device as claimed in claim 24, in which said fill-in signal generating means is a manual switch provided in a panel section.

27. A device as claimed in claim 24, in which said fill-in signal generating means is a foot switch which can provide a signal under the condition that a fill-in foot switch select switch provided in a panel section is turned on.

28. A device as claimed in claim 24, in which said particular performance pattern essentially includes drum solo.

* * * * *